US007433625B2

(12) United States Patent
Yamaoka et al.

(10) Patent No.: US 7,433,625 B2
(45) Date of Patent: Oct. 7, 2008

(54) IMAGE HEATING APPARATUS

(75) Inventors: Takahiko Yamaoka, Kashiwa (JP); Kuniyasu Kimura, Toride (JP); Yuichi Yamamoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 132 days.

(21) Appl. No.: 11/470,433

(22) Filed: Sep. 6, 2006

(65) Prior Publication Data

US 2007/0059022 A1 Mar. 15, 2007

(30) Foreign Application Priority Data

Sep. 13, 2005 (JP) ..... 2005-265881

(51) Int. Cl.
*G03G 21/20* (2006.01)

(52) U.S. Cl. ..... 399/92; 399/43

(58) Field of Classification Search ..... 399/33, 399/43, 69, 92, 320

See application file for complete search history.

(56) References Cited

U.S. PATENT DOCUMENTS

| | | | | |
|---|---|---|---|---|
| 5,148,226 | A | 9/1992 | Setoriyama et al. | 355/290 |
| 5,210,579 | A | 5/1993 | Setoriyama et al. | 355/285 |
| 5,525,775 | A | 6/1996 | Setoriyama et al. | 219/216 |
| 2007/0086803 | A1 | 4/2007 | Kimura et al. | 399/69 |

FOREIGN PATENT DOCUMENTS

| | | | |
|---|---|---|---|
| JP | 60-136779 | | 7/1985 |
| JP | 4-44075 | | 2/1992 |
| JP | 4-44076 | | 2/1992 |
| JP | 4-44077 | | 2/1992 |
| JP | 4-44078 | | 2/1992 |
| JP | 4-44079 | | 2/1992 |
| JP | 4-44080 | | 2/1992 |
| JP | 4-44081 | | 2/1992 |
| JP | 4-44082 | | 2/1992 |
| JP | 4-44083 | | 2/1992 |
| JP | 04051179 | A * | 2/1992 |
| JP | 4-204980 | | 7/1992 |
| JP | 4-204981 | | 7/1992 |
| JP | 4-204982 | | 7/1992 |
| JP | 4-204983 | | 7/1992 |
| JP | 4-204984 | | 7/1992 |
| JP | 5-181382 | | 7/1993 |
| JP | 05181382 | A * | 7/1993 |
| JP | 2002287564 | A * | 10/2002 |

* cited by examiner

*Primary Examiner*—David M. Gray
*Assistant Examiner*—Kristofferson Service
(74) *Attorney, Agent, or Firm*—Fitzpatrick, Cella, Harper & Scinto

(57) ABSTRACT

An image heating apparatus including an image heater for heating an image on a recording material in a nip portion, an air blower for blowing air toward an air blowing port to cool a predetermined area of the image heater, and a shutter for opening an closing the air blowing port, wherein when recording materials change in width in the course of continuously executing an image heating process accompanied by a cooling operation, the shutter is kept opened until the number of recording materials after the change reaches a predetermined number, whereby the frequency of the driving of the shutter for the air blowing port when small size recording materials and large size recording materials are mixed-loaded and passed is reduced to thereby achieve the longer life of a shutter driving portion, the electric power saving of the apparatus and a reduction in opening-closing noise.

2 Claims, 21 Drawing Sheets

FIG. 19A

| SHEET SIZE | CLOSURE PLATE DRIVE |
|---|---|
| LARGE | CLOSE |
| LARGE | CLOSE |
| LARGE | CLOSE |
| SMALL | CLOSE |
| SMALL | OPEN OPERATION OF CLOSURE PLATE |
| SMALL | OPEN |
| SMALL | OPEN |

FIG. 19B

| SHEET SIZE | CLOSURE PLATE DRIVE |
|---|---|
| SMALL | OPEN |
| SMALL | OPEN |
| SMALL | OPEN |
| LARGE | OPEN |
| LARGE | CLOSE OPERATION OF CLOSURE PLATE |
| LARGE | CLOSE |
| LARGE | CLOSE |

FIG. 19C

| SHEET SIZE | CLOSURE PLATE DRIVE |
|---|---|
| SMALL | OPEN |
| SMALL | OPEN |
| SMALL | OPEN |
| LARGE | OPEN (NO MOVEMENT OF CLOSURE PLATE) |
| SMALL | OPEN |
| SMALL | OPEN |
| SMALL | OPEN |

FIG. 19D

| SHEET SIZE | CLOSURE PLATE DRIVE |
|---|---|
| LARGE | CLOSE |
| LARGE | CLOSE |
| LARGE | CLOSE |
| SMALL | CLOSE |
| LARGE | CLOSE |
| SMALL | CLOSE |
| LARGE | CLOSE |

FIG. 19E

| SHEET SIZE | CLOSURE PLATE DRIVE |
|---|---|
| SMALL | OPEN |
| SMALL | OPEN |
| SMALL | OPEN |
| LARGE | OPEN |
| SMALL | OPEN |
| LARGE | OPEN |
| SMALL | OPEN |

FIG. 19F

| SHEET SIZE | CLOSURE PLATE DRIVE |
|---|---|
| SMALL | OPEN |
| SMALL | OPEN |
| SMALL | OPEN |
| LARGE | OPEN |
| SMALL | OPEN |
| LARGE | CLOSE OPERATION OF CLOSURE PLATE |
| SMALL | CLOSE |

FIG. 22 *PRIOR ART*

| SHEET SIZE | CLOSURE PLATE DRIVE |
|---|---|
| LARGE | CLOSE |
| SMALL | OPEN |
| LARGE | CLOSE |
| SMALL | OPEN |
| LARGE | CLOSE |
| SMALL | OPEN |
| LARGE | CLOSE |
| SMALL | OPEN |
| LARGE | CLOSE |
| SMALL | OPEN |

IMAGE HEATING APPARATUS

BACKGROUND OF THE INVENTION

1. Field of the Invention

The present invention relates to an image heating apparatus for heating an image on a recording material. As such image heating apparatus, mention can be made, for example, a fixing apparatus for fixing an unfixed image on a recording material, a gloss improving apparatus or the like for heating an image fixed on a recording material to thereby improve the gloss of the image. Also, such an image heating apparatus is used, in an image forming apparatus such as, for example, a copying machine, a printer, a facsimile apparatus or a compound machine provided with a plurality of functions of these.

2. Description of the Related Art

Heretofore, in an image forming apparatus of an electrophotographic printing method, a technique of forming a toner image on a recording material such as paper by a technique called the Carlson process, and thereafter fixing the toner image as a permanent image has been popular.

As fixing methods therefore, various methods have been proposed, but from the viewpoint of fixability, a method of heating and fixing a toner image (heat-fixing method) is popular. Above all, a method of directly bringing a toner image into contact with a rotary member containing a heating source therein to thereby fix the toner image is widely used.

In this heat-fixing method, it is important to uniformize the temperature distribution or a heating rotary member such as a roller or film, including an area through which a recording material (hereinafter referred to as the paper) passes, relative to an axial direction. For if there is a portion in which the temperature is lower than a predetermined temperature, there is the possibility of faulty fixing occurring, and on the other hand, if the temperature is too high, there is the possibility of the heating rotary member or a member proximate thereto receiving thermal damage. Further, if the temperature of a non-sheet passing portion has become too high as compared with the temperature of a sheet passing portion, the temperature of the end portion of the sheet passing portion becomes too high as compared with a proper fixing temperature, and this gives rise to the fear that hot offset should occur.

In recent years, there is a demand for an image forming apparatus which copes with various paper sizes from paper of a relatively large size such as, for example, A3 size to paper of small sizes such as A4R and B5 size usually used. Therefore, it is necessary to construct the axial lengths of the heating rotary member and a pressure rotary member so as to correspond to a relatively large size such as, for example, A3 size. However, in a case where the construction as previously described is adopted, when paper of a small size such as A4R or B5 passes through a fixing apparatus, a non-sheet passing area through which the paper does not pass increases in the effective fixing area of the heating rotary member. When copying is continuously effected on the paper of a small size, heat is not taken away from the surface of the heating rotary member corresponding to the non-sheet passing area by the paper and therefore, the surface temperature of the non-sheet passing area becomes very high.

In order to solve the above-noted temperature rise of the non-sheet passing portion, the following propositions have been made.

Conventional Example 1: the supply of heat to the heating rotary member is stopped between sheets, and idle rotation or the like is effected so that the surface temperature of the heating rotary member in the non-sheet passing area may become the same as the surface temperature of the sheet passing area to thereby cope with the problem.

Conventional Example 2: there is adopted a technique of changing the light distribution ratio of heating means such as a heater contained in the heating rotary member so that the quantity of heat supplied to the non-sheet passing area may be smaller than the quantity of heat supplied to the sheet passing area for effecting the fixing of paper of a small size.

The above-described conventional examples, however, suffer from the following problems. In Conventional Example 1 described above, during the continuous supply or the like of small size paper, idle rotation for the cooling of the heating rotary member is necessary between sheets, and this gives rise to the problem that the productivity when the paper of a small size is supplied becomes bad. In recent years, a user's requirement for the productivity of the apparatus has gradually become higher, and it may lead to the possibility of becoming unable to satisfy the product specification required by the user to lower the productivity during the mixed loading of various sizes.

Next, when a construction like Conventional Example 2 is adopted, to cope with a plurality of paper sizes, it is necessary to dispose a heater having a plurality of light distributions, and this leads to the fear of an increased cost.

Also, in order to prevent the rise of the surface temperature of the non-sheet passing area during the supply of small size paper, there has been proposed a construction for cooling the non-sheet passing area by cooling air, as described in Japanese Patent Application Laid-open No. S60-136779 and Japanese Patent Application Laid-open No. H05-181382.

In a fixing apparatus described in Japanese Patent Application Laid-open No. S60-136779, the surroundings of a pressure roll is partitioned into a sheet passing area side and a non-sheet passing area side by a partition plate, and cooling air is blown from a cooling fan disposed in the interior of the fixing apparatus to the outer peripheral member of the pressure roll on the aforementioned non-sheet passing area side.

In Embodiment 1 (FIG. 21) described in Japanese Patent Application Laid-open No. H05-181382, a cooling fan 4 is disposed above a top plate 5 covering the upper part of a fixing roll 1; and normally air is blown to the upper side of the top plate 5 to thereby prevent the temperature rise around a fixing device. When paper passing through a fixing area is small size paper, a window 6 as a guide device provided in the top plate 5 is opened to thereby let cooling air flow to the surface portion of the fixing roll 1 rotated through the non-sheet passing area.

However, the apparatuses described in Japanese Patent Application Laid-open No. S60-136779 and Japanese Patent Application Laid-open No. H05-181382 suffers from the following problems.

In the conventional examples wherein cooling air is blown to the heating rotary member, a cooling fan is provided in the interior of the fixing apparatus and therefore, it is necessary to use a cooling fan of high heat resistance, and this leads to the fear of an increased cost. Also, a cooling fan having a relatively great air flow amount becomes necessary, and the fixing apparatus itself becomes bulky. Also, there is the problem that even if a partition plate is provided, cooling air flows from the non-sheet passing area side into the sheet passing area, and the temperature is lowered near the boundary between the sheet passing area and the non-sheet passing area and the fixing temperature of the partition boundary portion becomes low to thereby cause faulty fixing.

As means for solving the above-noted problem, a fixing apparatus of the following construction has been proposed. That is, the fixing apparatus is provided with a cooling device having a non-sheet passing area cooling duct having an air blowing port formed in opposed relationship with the surface of the non-sheet passing area of a heating rotary member in order to cool the surface of the non-sheet passing area of the heating rotary member, and an air blowing fan for blowing cooling air to the duct. It has a shutter (closure plate) for adjusting an area for blowing the cooling air to the above-mentioned non-sheet passing area to an optimum width in accordance with the width of small size paper. The fixing apparatus further has an opening width adjusting member for adjusting the opening width by the shutter in accordance with the width of the aforementioned small size paper.

Also, the cooling fan for blowing the aforementioned cooling air has control means for switching on and off the cooling fan at predetermined timing by the use of the result of the temperature detection of the aforementioned non-sheet passing area. Further, the shutter for adjusting the area blowing the aforementioned cooling air to an optimum opening width in accordance with the width of the small-sized sheet shields the heating rotary member and the cooling fan. Therefore, there can be provided a fixing apparatus in which the temperature of the cooling fan portion does not rise, and which can efficiently prevent temperature rise at a low cost/saved space without using a cooling fan of high heat resistance, and is also excellent in safety.

The above-described proposition, however, suffers from the following problem. In a case where a print job in which paper of a large size and paper of a small size are mixedly prevent is executed, if as shown in FIG. 22 of the accompanying drawings, the changeover operation of the position of the shutter is performed each time the paper size changes between the large size and the small size, there will arise the problem that the life of a shutter driving portion becomes short. Also, if the movement of the shutter is carried out at a high frequency, it will lead to an increase in the electric power consumption of the apparatus.

SUMMARY OF THE INVENTION

It is an object of the present invention to provide an image heating apparatus which can reduce the frequency of the opening and closing operation of a shutter as far as possible.

It is another object of the present invention to provide an image heating apparatus which can achieve the longer life of a shutter.

It is an object of the present invention to provide an image heating apparatus comprising image heating means for heating an image on a recording material in a nip portion, air blowing means for blowing air toward an air blowing port to cool a predetermined area of the image heating means, and a shutter, which opens and closes the air blowing port, wherein when the recording materials change in width in the course of continuously executing an image heating process accompanied by a cooling operation, the shutter is kept opened until the number of recording materials after the change reaches a predetermined number.

Also, it is an object of the present invention to provide an image heating apparatus comprising image heating means for heating an image on a recording material in a nip portion, air blowing means for blowing air toward an air blowing port to cool a predetermined area of the image heating means, and a shutter, which opens and closes the air blowing port, wherein when the recording materials change in width in the course of continuously executing an image heating process accompanied by a cooling operation, the shutter is kept opened until an image heating process time for the recording material after the change reaches a predetermined time.

Further features of the present invention will become apparent from the following description of exemplary embodiments with reference to the attached drawings.

BRIEF DESCRIPTION OF THE DRAWINGS

FIGS. 19A, 19B, 19C, 19D, 19E and 19F are illustrations of the shutter driving during the mixed loading of sizes.

FIG. 22 is an illustration of the shutter driving during the mixed loading of recording materials of large and small sizes in the conventional example.

DESCRIPTION OF THE EMBODIMENTS

The present invention will hereinafter be described more specifically with respect to an embodiment thereof. The embodiment is the best embodiment of the present invention, but the present invention is not restricted to various constructions described in the embodiment. That is, the various constructions described in the embodiment can be substituted for by other known constructions within the scope of the idea of the present invention.

Embodiment 1

(1) Image Forming Apparatus

Figure 2:
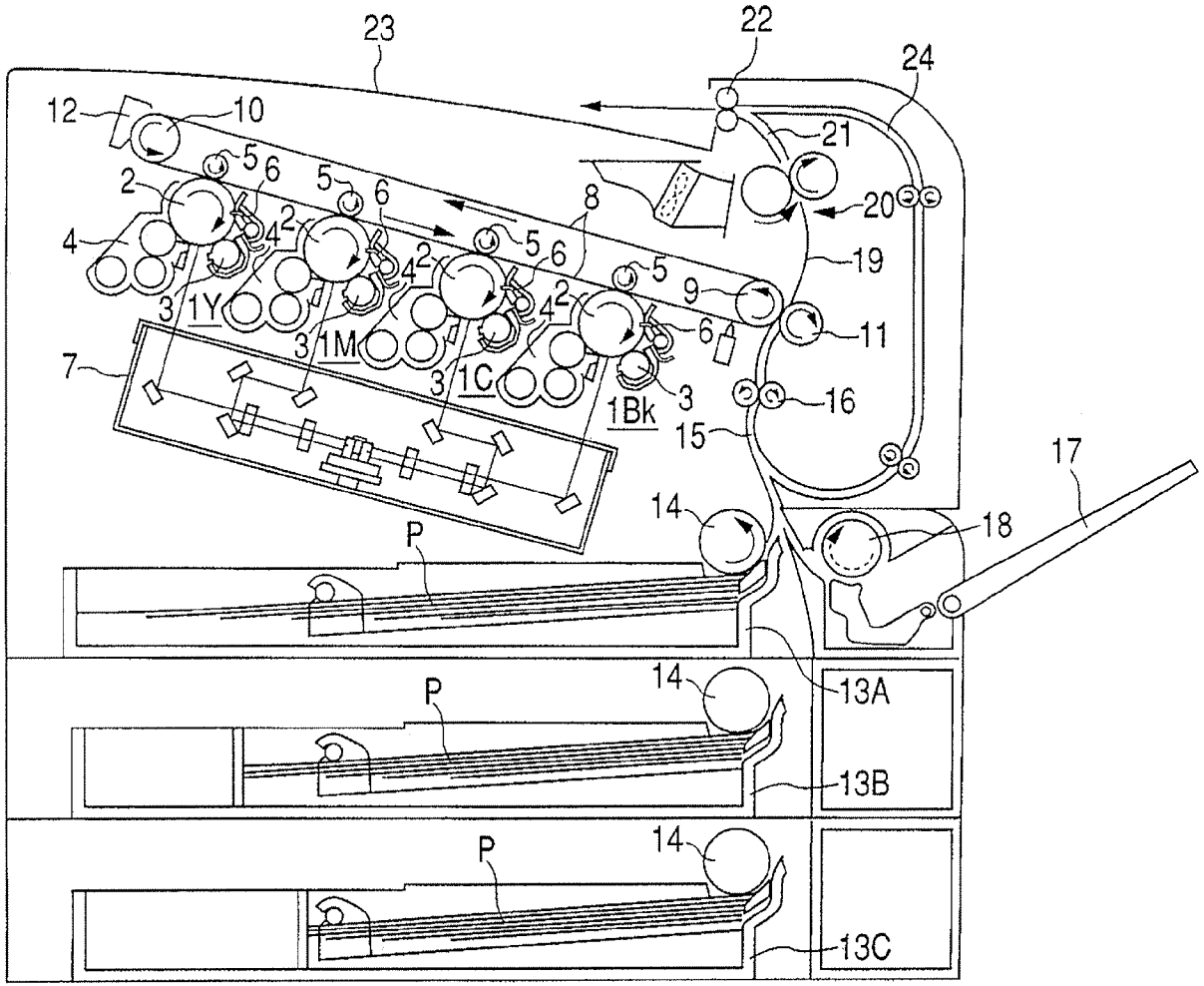
FIG. 2 is a longitudinal cross-sectional typical view of an example of an image forming apparatus carrying the fixing apparatus thereon.

FIG. 2 is a longitudinal cross-sectional typical view schematically showing the construction of an electrophotographic full-color printer which is an example of an image forming apparatus according to the present invention. Description will first be made of the epitome of an image forming portion which is image forming means for forming an image on a recording material.

This printer can perform an image forming operation in conformity to input image information from an external apparatus such as a computer, a work station or an image reader to thereby form a full-color image on a recording material and output it.

An endless and flexible intermediate transfer belt (hereinafter simply referred to as the belt) 8 is stretched around a secondary transfer opposed roller 9 and a tension roller 10, and is rotatively driven at a predetermined speed in the counter-clockwise direction indicated by the arrow by the roller 9 being driven. A secondary transfer roller 11 is brought into pressure contact with the above-mentioned secondary transfer opposed roller 9 with the belt 8 interposed therebetween. The contact portion between the belt 8 and the secondary transfer roller 11 is a secondary transferring portion.

First to fourth image forming portions 1Y, 1M, 1C and 1Bk are disposed in a line at predetermined intervals along the movement direction of the belt 8 under the belt 8. Each image forming portion is an electrophotographic process mechanism of a laser exposing type, and has a drum-shaped electrophotographic photosensitive member (hereinafter simply referred to as the drum) 2 as an image bearing member rotatively driven at a predetermined speed in the clockwise direction indicated by the arrow. Around each drum 2, there are disposed a primary charger 3, a developing apparatus 4, a transfer roller 5 as transferring means, and a drum cleaner device 6. Each transfer roller 5 is disposed inside the belt 8, and is brought into pressure contact with a corresponding drum 2 with the underlying belt portion of the belt 8 interposed therebetween. The contact portion between each drum 2 and the belt 8 is a primary transferring portion. A laser exposing apparatus 7 for the drums 2 of the image forming portions is comprised of laser beam emitting means for effecting laser beam emission corresponding to the time-series electrical digital pixel signal of given image information, a polygon mirror, a reflecting mirror, etc.

A control portion in the image forming apparatus causes each image forming portion to perform an image forming operation, on the basis of a color resolving image signal inputted from the external apparatus. Thereby, in the first to fourth image forming portions 1Y, 1M, 1C and 1Bk, yellow, magenta, cyan and black color toner images are formed on the surfaces of the rotating drums 2 at predetermined control timing. The principles and process of the electrophotographic image formation for forming the toner images on the drums 2 are known and therefore need not be described.

The toner images formed on the surfaces of the drums 2 of the respective image forming portions are successively superposed and transferred onto the outer surface of the belt 8 being rotatively driven in a forward direction relative to the rotation direction of each drum 2 and at a speed corresponding to the rotating speed of each drum 2. Thereby, an unfixed full-color toner image by the superposition of the above-mentioned four toner images is compositely formed on the surface of the belt 8.

On the other hand, of multi-stage cassette sheet supplying portions 13A, 13B and 13C stacking and containing therein recording materials P of large and small width sizes, the sheet feeding roller 14 of the sheet supplying cassette at a selected stage is driven. Thereby, one of the recording materials P stacked and contained in the sheet supplying cassette at that stage is separated and fed and is conveyed to registration rollers 16 through a vertical conveying path 15. When manual sheet feeding is selected, a sheet feeding roller 18 is driven. Thereby, one of recording materials stacked and set on a manually feeding tray (multi-purpose tray) 17 is separated and fed and is conveyed to the registration rollers 16 through the vertical conveying path 15.

The registration rollers 16 timing-convey the recording material P so that the leading edge portion of the recording material P may arrive at the secondary transferring portion in timed relationship with the arrival of the leading edge of the above-mentioned full-color toner image at the secondary transferring portion. Thereby, in the secondary transferring portion, the full-color toner image on the belt 8 is collectively secondary-transferred to the surface of the recording material P. The recording material P having left the secondary transferring portion is separated from the surface of the belt 8, is guided by a vertical guide 19 and is introduced into a fixing apparatus 20. The above-mentioned toner image of plural colors is fused and color-mixed by this fixing apparatus 20 and is fixed as a permanently secured image on the surface of the recording material. The recording material having left and fixing apparatus 20 passes through a conveying path 21 as a full-color image-formed article and is fed onto a sheet discharge tray 23 by discharge rollers 22.

The surface of the belt 8 after the separation of the recording material in the secondary transferring portion is cleaned by being subjected to the removal of residual adhering substances such as any secondary-untransferred toners by a belt cleaning device 12, and is repetitively used for image formation.

In the case of a monochromatic print mode, only the fourth image forming portion 1Bk for forming a black toner image has its image forming operation controlled. When a two-side print mode is selected, a recording material having had its first side printed is fed out onto the sheet discharge tray 23 by the discharge rollers 22, and the rotation of the sheet discharge rollers 22 is changed to a reverse rotation at a point of time immediately before the trailing edge portion of the recording material passes between the discharge rollers 22. Thereby, the recording material is switched back and is introduced into a conveying path 24. Then, the recording material comes into a reversed state and is again conveyed to the registration rollers 16. Thereafter, as in the case of the first side print, the recording material is conveyed to the secondary transferring portion and the fixing apparatus 20, and is conveyed onto the sheet discharge tray 23 as a two-side print image-formed article.

Figure 3:
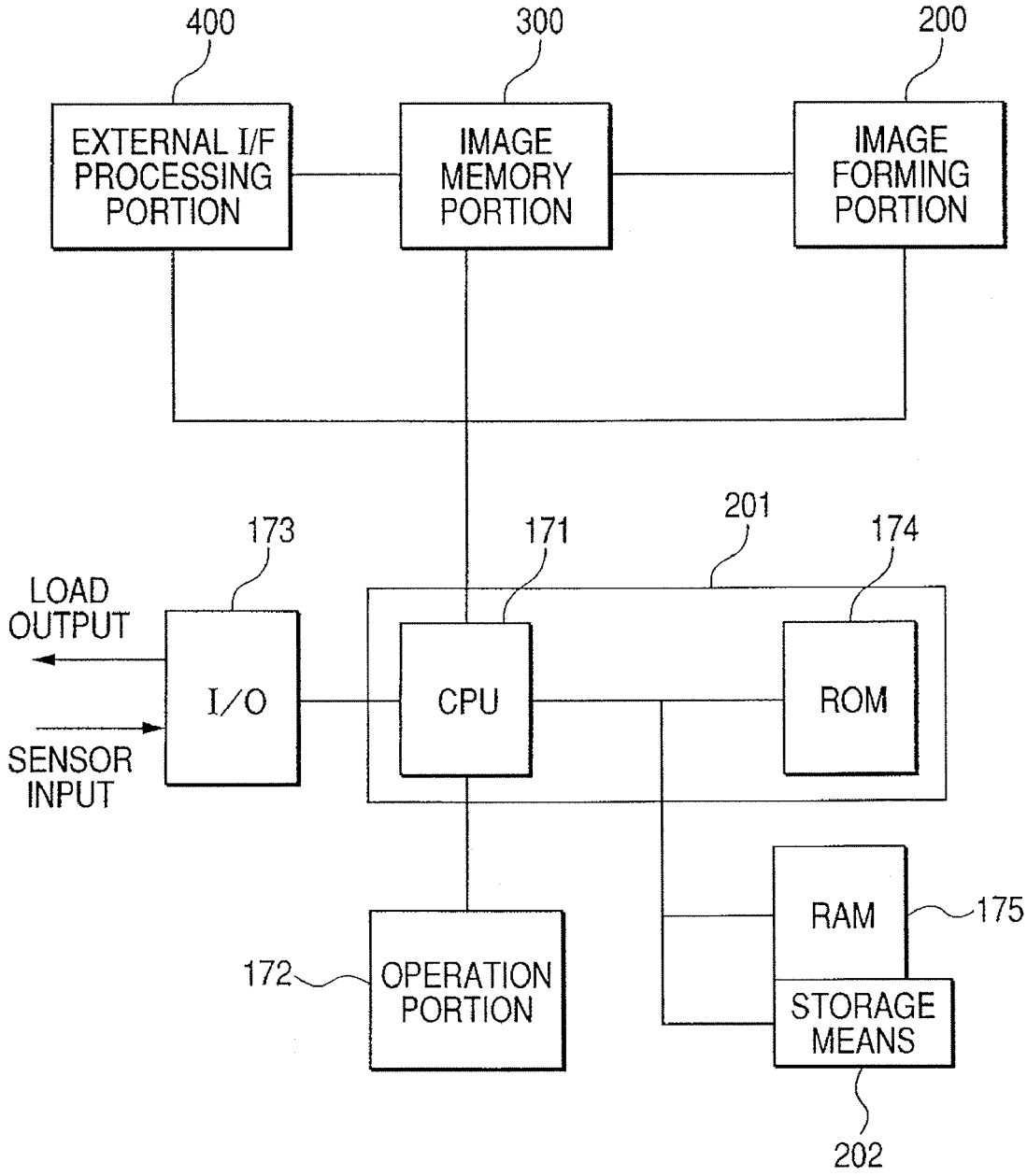
FIG. 3 is a block diagram of a control system.

FIG. 3 is a block diagram of a control portion (controlling means) in the image forming apparatus. The reference numeral 171 designates a CPU which effects the basic control of the image forming apparatus, and a ROM 174 in which a control program is written, a work RAM 175 for carrying out processing and an input/output port 173 are connected thereto by an address bus and a data bus. The input/output port 173 has connected thereto various loans (not shown) such as a motor and a clutch for controlling the image forming apparatus, and the input (not shown) of a sensor for detecting the position of the recording material.

The CPU 171 sequentially effects the control of the input and output through the input/output port 173 in accordance with the contents of the ROM 174 and executes an image forming operation. Also, the CPU 171 has an operation portion 172 connected thereto, and controls the display means and key input means of the operation portion 172. An operator instructs the CPU 171 to change over the image forming operation mode and display, through the key input means. The CPU 171 effects the display of the state of the image forming operation and the operation mode setting by a key input. The CPU 171 has connected thereto an external I/F processing portion 400 for transmitting and receiving image data, processing data, etc. from an external apparatus such as a PC. Also, the CPU 171 has connected thereto an image memory portion 300 which carries out the process of expanding an image and the process of temporarily accumulating images, and an image forming portion 200 in which processing is effected to expose line image data forwarded from the image memory portion 300 to the exposing device 7.

Figure 4:
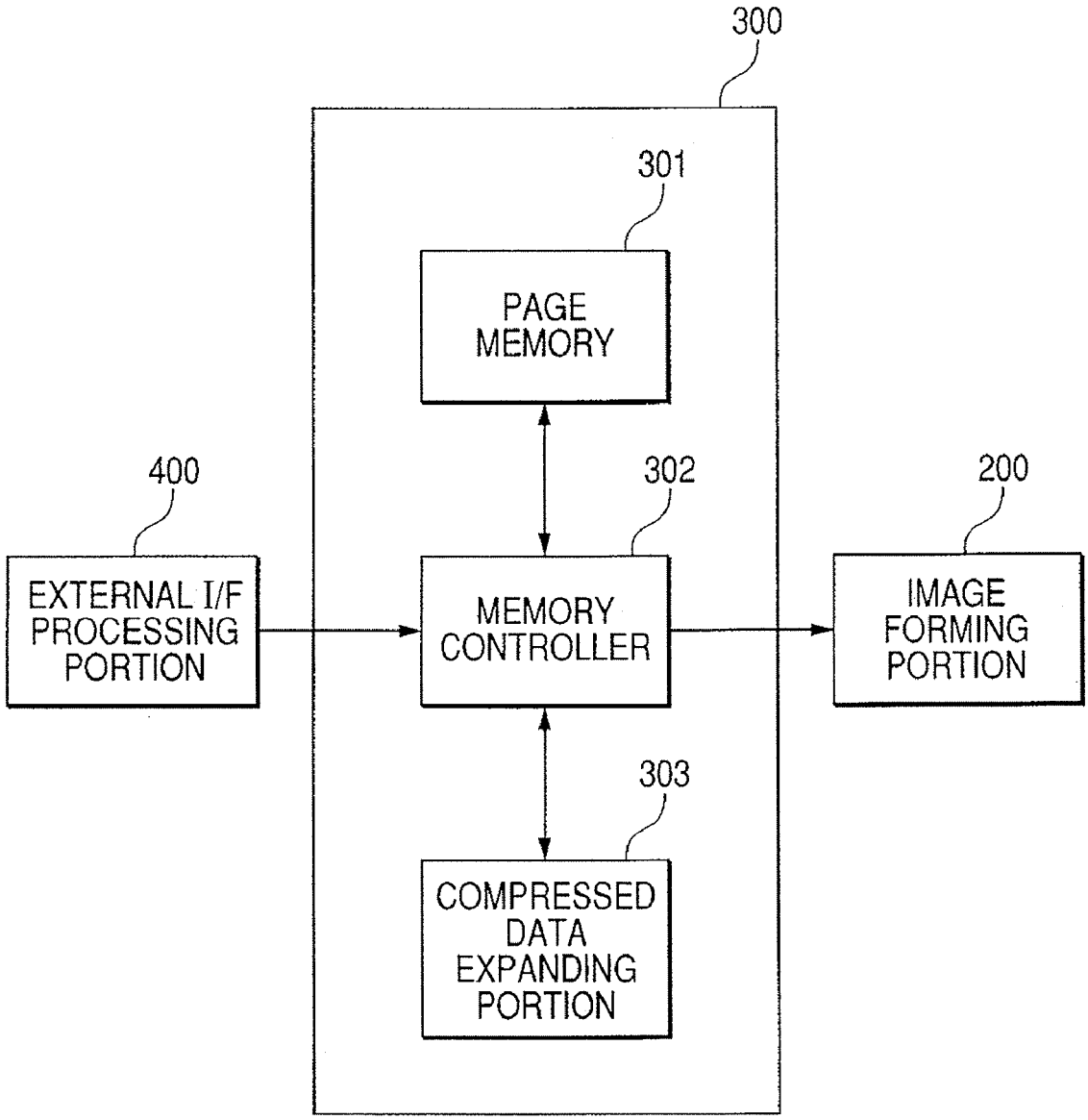
FIG. 4 is a block diagram of an image memory portion.

The details of the image memory portion 300 will now be described with reference to FIG. 4. In the image memory portion 300, image data received from the external I/F processing portion 400 through a memory controller portion 302 is written into a page memory 301 comprised of a memory such as a DRAM, and the access of the input and output of an image such as image reading-out to the image forming portion 200.

The memory controller portion 302 judges whether the image data from the external apparatus received from the external I/F processing portion 400 is compressed data. If it is judged to be compressed data, an expanding process is carried out by the use of a compressed data expanding process portion 303, whereafter a writing-in process is carried out into the page memory 301 through the memory controller portion 302.

The memory controller portion 302 effects the production of the DRAM refresh signal of the page memory 301, and effects the mediation of the access to the page memory 301 for the reading-out to the image forming portion 200. It further effects the control of the writing-in address to the page memory 301, the reading-out address from the page memory 301, the reading-out direction, etc.

Figure 5:
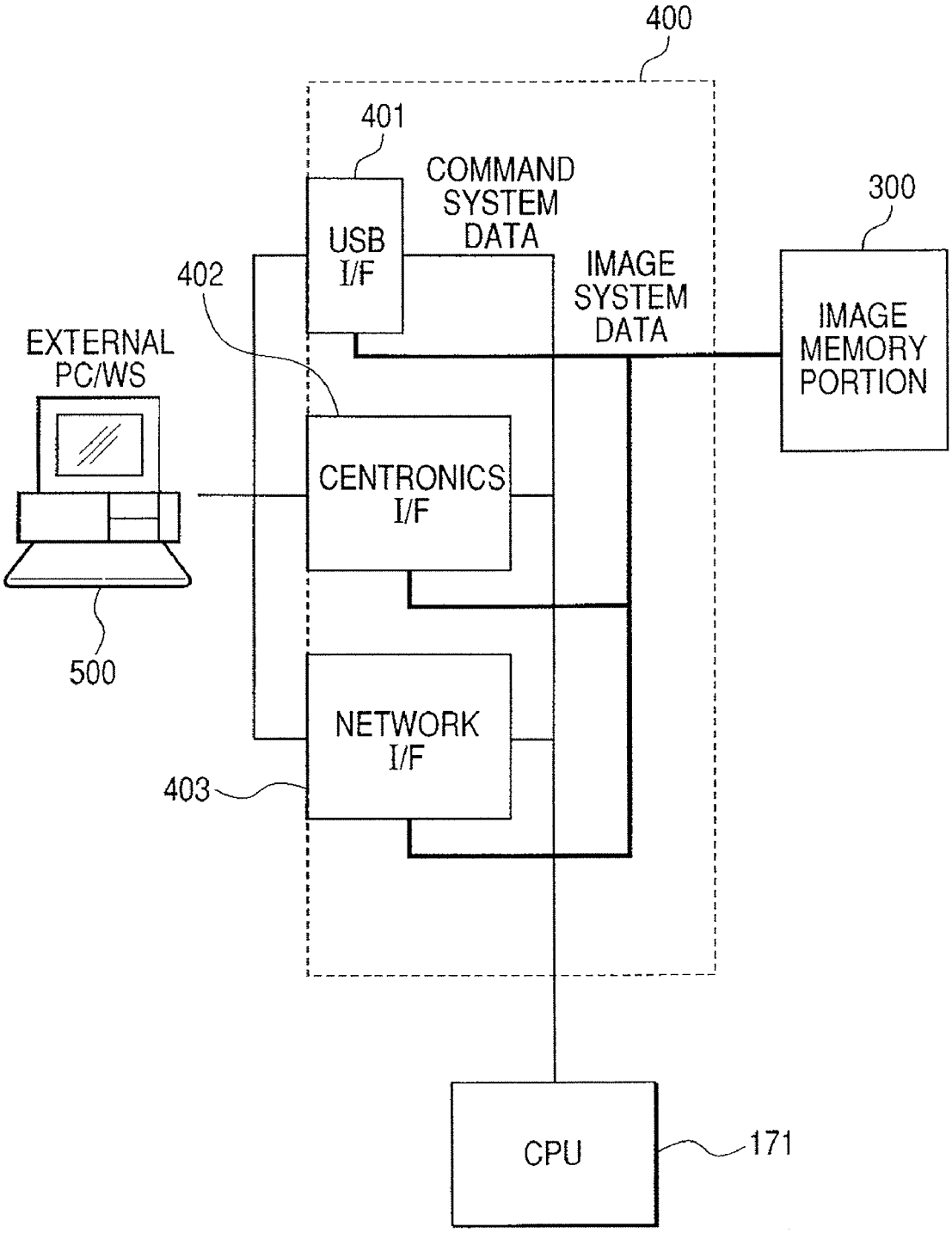
FIG. 5 is a block diagrams of an external I/F processing portion.

The construction of the external I/F processing portion 400 will now be described with reference to FIG. 5. In the external I/F processing portion 400, image data and print command data transmitted from an external apparatus 500 are received through one of a USB I/F portion 401, a Centronics I/F portion 402 and a network I/F portion 403. Also, conversely, the state information or the like of the image forming apparatus judged by the CPU 171 is transmitted to the external apparatus 500. Here, the external apparatus 500 is a computer, a work station or the like.

The print command data received from the external apparatus 500 through one of the USB I/F portion 401, the Centronics I/F portion 402 and the network I/F portion 403 is processed by the CPU 171. Then, the CPU 171 produces the setting or timing for executing a printing operation by the use of the image forming portion 200 or the I/O 173 of FIG. 3.

The image data received from the external apparatus 500 through one of the USB I/F portion 401, the Centronics I/F portion 402 and the network I/F portion 403 is transmitted to the image memory portion 300 in accordance with the timing based on the print command data. Then, the image data is processed to be image-formed by the image forming portion 200.

(2) Fixing Apparatus 20

In the following description, the longitudinal direction with respect to the fixing apparatus or a member constituting the same is a direction parallel to a direction orthogonal to a recording material conveying direction in the surface of a recording material conveying path. Regarding the fixing apparatus, the front surface is a surface on a recording material introducing side, and the left or right is the left or right when the apparatus is viewed from the front surface. The width of the recording material is the dimension of the recording material in a direction orthogonal to the recording material conveying direction on the surface of the recording material.

Figure 1:
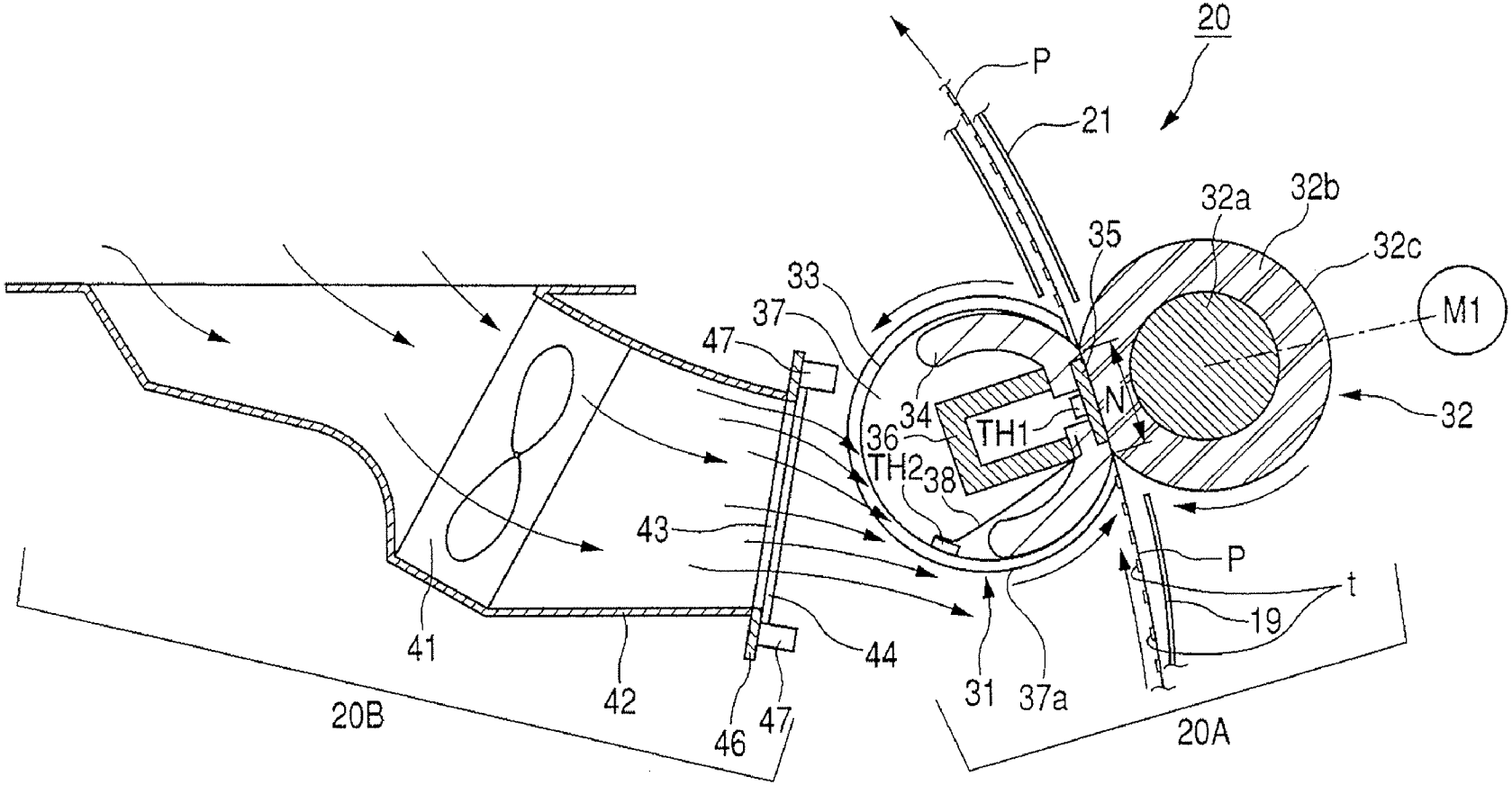
FIG. 1 is a transverse cross-sectional typical view schematically showing the construction of a fixing apparatus (image heating apparatus) according to Embodiment 1.
Figure 6:
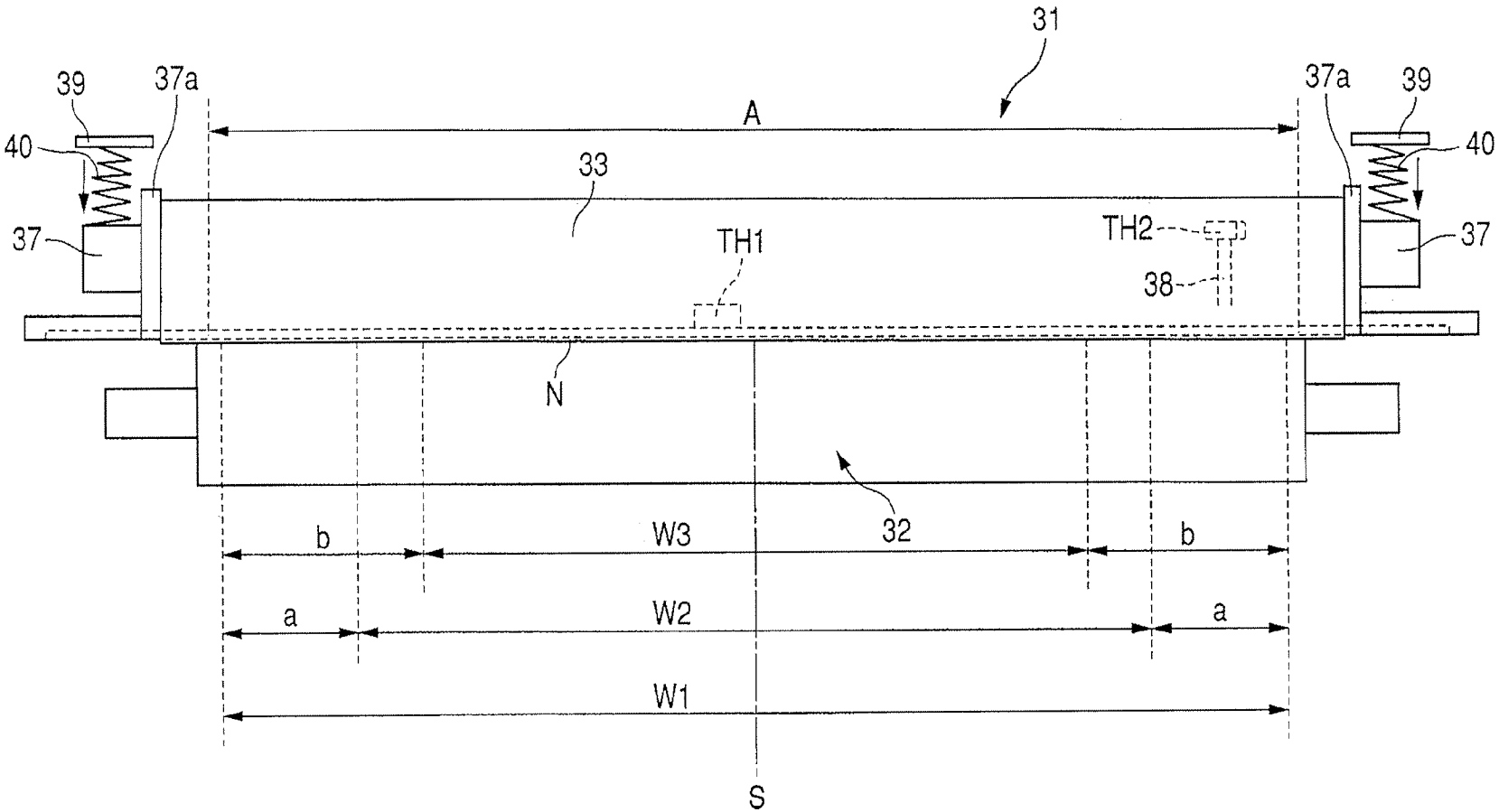
FIG. 6 is a typical front view of the fixing mechanism portion of the fixing apparatus.
Figure 7:
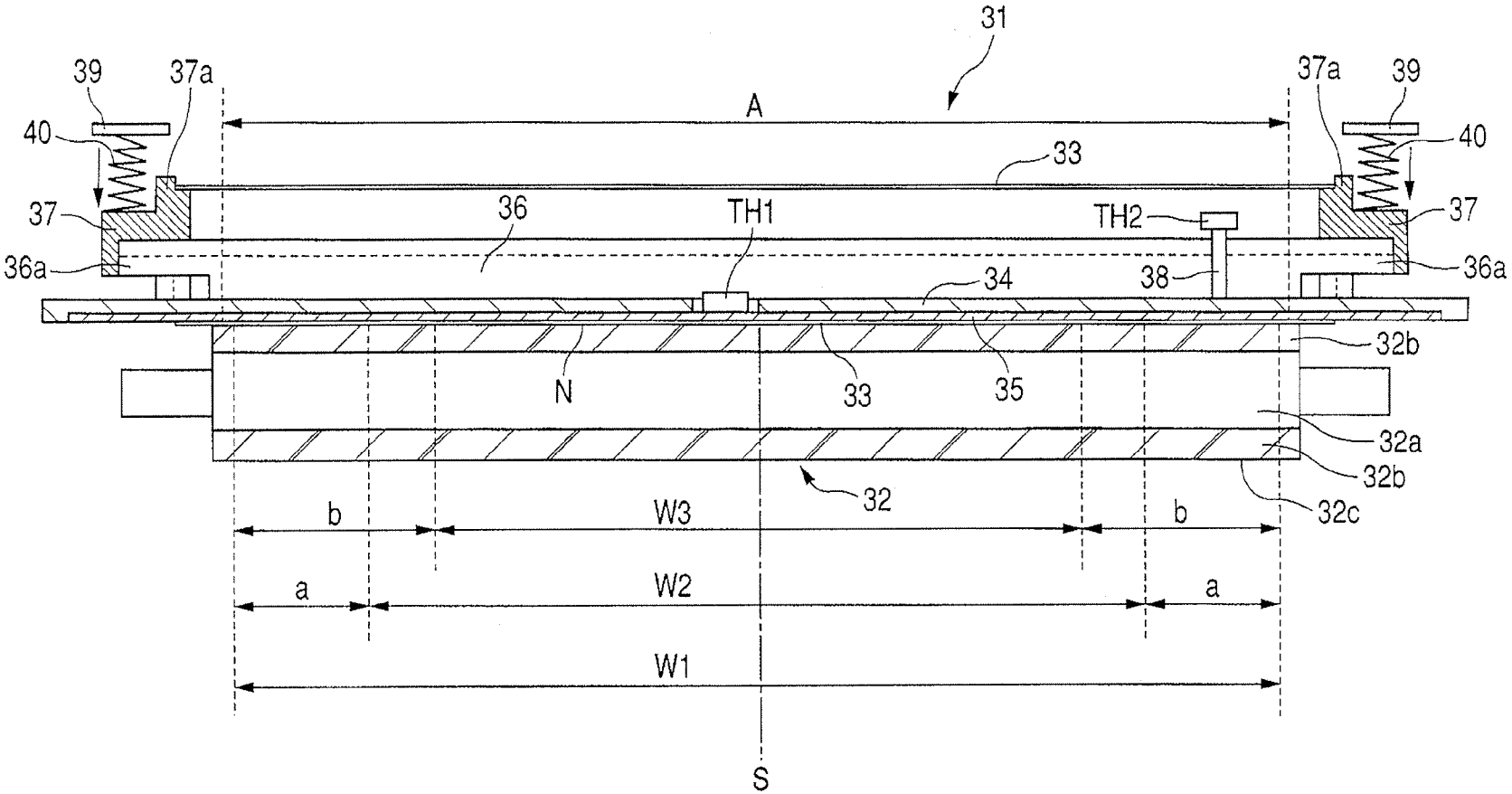
FIG. 7 is a longitudinal typical front view of the fixing mechanism portion.

FIG. 1 is a transverse cross-sectional typical view schematically showing the construction of the fixing apparatus 20 as the image heating apparatus according to the present embodiment. This fixing apparatus 20 generally comprises a fixing mechanism portion (image heating means or a fixing device) 20A of a film (belt) heating type and an air blowing cooling mechanism portion (cooling means or a cooling device) 20B. FIG. 6 is a typical front view of the fixing mechanism portion 20A, and FIG. 7 is a longitudinal cross-sectional typical front view thereof.

(2-1) Fixing Mechanism Portion 20A

The epitome of the fixing mechanism portion 20A will first be described. The fixing mechanism portion 20A is basically an on-demand fixing apparatus of a film heating type and a pressure rotary member driving type (tensionless type) disclosed in Japanese Patent Application Laid-open No. H04-44075 to H04-44083, H04-204980 to H04-204984, etc.

The reference numeral 31 designates a film assembly as a first fixing member (heating member), and the reference numeral 32 denotes an elastic pressure roller as a second fixing member (pressure member), and a fixing nip (sheet-passing nip) portion N is formed by the pressure contact between these two.

The film assembly 31 includes fixing film (fixing belt or thin-walled roller: hereinafter simply referred to as the film) 33, a film guide member (hereinafter simply referred to as the guide member) 34 of a semiarcuate trough shape having heat resistance and rigidity, and a ceramic heater (hereinafter simply referred to as the heater) 35 as a heating source. The ceramic heater 35 is disposed by being fixedly fitted in a concave groove portion provided in the outer surface of the guide member 34 along the length of the guide member 34. The film 33 is loosely fitted on the guide member 34 having the heater 35 mounted thereon. The reference numeral 36 designates a rigid pressure stay (hereinafter simply referred to as the stay) having a U-shaped transverse cross section, and disposed inside the guide member 34. The reference numeral 37 denotes end portion holders fitted to the outwardly protruding arm portions 36*a* of the left and right end portions of the stay 36, and the reference character 37*a* designates flange portions integral with these end portion holders 37.

The pressure roller 32 which is a pressure rotary member comprises a cored bar 32*a* and an elastic layer 32*b* of silicone rubber or the like provided thereon to thereby lower the hardness thereof. In order to improve the surface property of the pressure roller 32, a fluororesin layer 32*c* of PTFE, PFA, FEP or the like may be further provided on the outer periphery thereof. The pressure roller 32, as the pressure rotary member, is disposed with the opposite end portions of the cored bar 32*a* rotatably bearing-held between the left and right side plates of the chassis (not shown) of the apparatus through bearing members.

The film assembly 31 is arranged in parallelism to the above-described pressure roller 32 with its heater 35 side opposed to the pressure roller, and compression springs 40 are compression-disposed between the left and right end portion holders 37 and left and right fixed spring receiving members 39. Thereby, the stay 36, the guide member 34 and the heater 35 are biased toward the pressure roller 32 side. The biasing force is set to a predetermined level, and the heater 35 is brought into pressure contact with the pressure roller 32 against the elastic force of the elastic layer 32*b* with the film 33 interposed therebetween to thereby form a fixing nip portion N of a predetermined width in the recording material conveying direction between the film 33 and the pressure roller 32.

Figure 8:
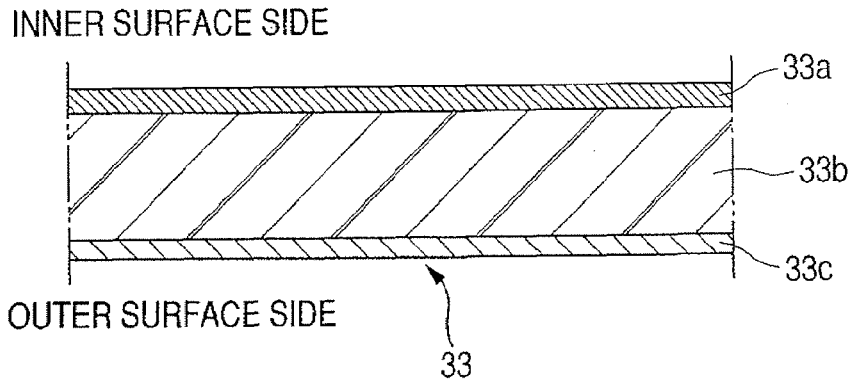
FIG. 8 is a layer construction model view of fixing film.

The film 33 in the present embodiment is of three-layer compound structure comprising, in succession from the inner surface side to the outer surface side, a base layer 33*a*, an elastic layer 33*b* and a releasing layer 33*c*, as shown in the layer construction typical view of FIG. 8. As the base layer 33*a*, in order to make the heat capacity thereof small and improve the quick starting property thereof, use can be made of heat-resistant film having a film thickness of 100 μm or less, and preferably 50 μm or less and 20 μm or greater. Use can be made of film of for example, polyimide, polyimide-amide, PEEK, PES, PPS, PTFE, PFA or FEP. In the present embodiment, use is made of cylindrical polyimide film having a diameter of 25 mm. As the elastic layer 33*b*, use is made of silicone rubber having rubber hardness of 10 degrees (JIS-A), heat conductivity of $4.18605\times10^{-1}$ W/m·degrees ($1\times10^{-3}$ [cal/cm. sec. deg]), and a thickness of 200 μm. As the releasing layer 33*c*, use is made of a PFA coat layer having a thickness of 20 μm. Use may be made of a PFA tube. The PFA coat is excellent in that it can be made small in thickness and in terms of the quality of material, as compared with the PFA tube, it is greater in the effect of wrapping the toner. On the other hand, in mechanism and electrical strength, the PFA tube is more excellent than the PFA coat and in some cases, it can be properly used.

Figure 9:
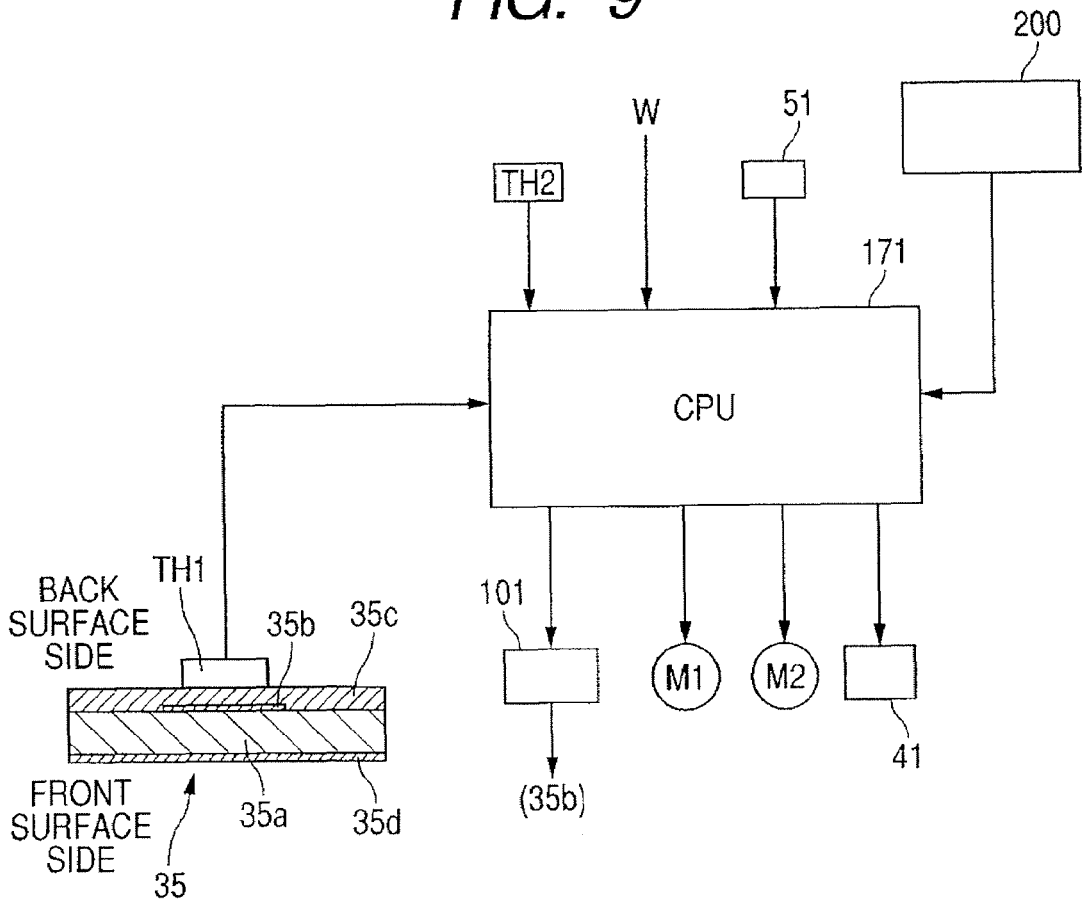
FIG. 9 is a transverse cross-sectional model view of a heater and a block diagram of a control system.

The heater 35 in the present embodiment is of a back side heating type using aluminum nitride or the like as a heater substrate, and is a laterally long linear heating member of a low heat capacity having its length in a direction orthogonal to the movement direction of the fixing film 33 and the recording material P. FIG. 9 is a transverse cross-sectional typical view and a control system block diagram of the heater 35. This heater 35 has a heater substrate 35*a* formed of aluminum nitride or the like. The back surface side (a surface side opposite to the surface side opposed to the fixing film) of this heater substrate 35*a* has an electrically energized heat generating layer 35*b* provided by applying an electrical resistance material such as, for example, Ag/Pd (argentine/palladium) provided along the length to about 10 μm and a width of 1 to 5 mm by screen printing or the like. It further has a protective layer 35*c* of fluororesin or the like provided thereon. In the present embodiment, a sliding member (lubricating member) 35*d* is provided on the front surface side (the surface side opposed to the film) of the heater substrate 35*a*.

The heater 35 is fitted into and fixedly supported by a groove portion formed in the substantially central portion of the outer surface of the guide member 34 with its heater substrate surface side provided with the sliding member 35*d* exposed. In the fixing nip portion N, the surface of the sliding member 35*d* of this heater 35 and the inner surface of the belt 33 slide in contact with each other. The belt 33 which is a rotating image heating member is heated by the heater 35.

Electric power is supplied to between the lengthwise opposite ends of the electrically energized heat generating layer 35*b* of the heater 35, whereby the electrically energized heat generating layer 35*b* generates heat and the heater 35 quickly rises in temperature in the entire area of the effective heat generating width A in the longitudinal direction of the heater. The heater temperature is detected by a first temperature sensor (first temperature detecting means: central temperature sensor) TH1 such as a thermistor disposed in contact with the outer surface of the protective layer 35*c* of the heater. Then, the output thereof (a signal value regarding the temperature) is inputted to the CPU 171 through an A/D converter and the input/output port 173. The CPU 171 controls the electric power supply from a power source 101 to the electrically energized heat generating layer 35*b* so as to maintain the heater temperature at a predetermined fixing temperature, on the basis of the inputted detected temperature information. That is, the temperature of the belt 33 which is a heating rotary member heated by the heater 35 is controlled to the predetermined fixing temperature in accordance with the output of the first temperature sensor TH1.

The pressure roller 32 is rotatively driven in the counter-clockwise direction indicated by the arrow by a motor (driving means) M1. A rotating force acts on the belt 33 by a frictional force in the fixing nip portion N between the pressure roller 32 and the outer surface of the belt 33 by the rotative driving of this pressure roller 32. Thereby, the belt 33 is rotated around the guide member 34 in the counter-clockwise direction indicated by the arrow while the inner surface thereof is sliding in close contact with the heater 35 in the fixing nip portion N (a pressure roller driving type). The belt 33 is rotated at a peripheral speed substantially corresponding to the rotating peripheral speed of the pressure roller 32. The left and right flange portions 37*a* serve to receive, when the rotating belt 33 laterally moves to the left or right along the length of the guide member 34, the side edge portion of the belt on the laterally moving side and regulate the lateral movement. In order to reduce the mutual sliding frictional force of the heater 35 and the inner surface of the belt 33 in the fixing nip portion N, the sliding member 35*d* is disposed on the surface of the heater in the fixing nip portion N, and a lubricant such as heat-resistant grease is interposed between it and the inner surface of the belt 33.

Thus, the rotation of the pressure roller 32 is started on the basis of a print starting signal, and the heating-up of the heater 35 is started. In a state in which the rotating peripheral speed of the belt 33 has become steady and the temperature of the heater 35 has risen to a predetermined level, a recording material P bearing a toner image "t" thereon is introduced into the fixing nip portion N with its toner image bearing surface facing to the belt 33 side. The recording material P is in close contact with the heater 35 in the fixing nip portion N with the belt 33 interposed therebetween and passes through the fixing nip portion N together with the belt 33. In the passing process, heat is imparted to the recording material P by the belt 33 heated by the heater 35 and the toner image "t" is heated and fixed on the surface of the recording material P. The recording material P having passed through the fixing nip portion N is separated from the surface of the belt 33 and is discharged.

In the present embodiment, the conveyance of the recording material P is effected by the so-called center reference conveyance with the center of the recording material as the reference. That is, a recording material of any large or small width suppliable to the apparatus is such that the central portion of the recording material in the width direction thereof passes the central portion of the fixing film 33 in the longitudinal direction thereof. The letter S indicates the central sheet passing reference line (imaginary line) of the recording material.

W1 represents the sheet passing width (maximum sheet passing width) of a maximum width recording material suppliable to the apparatus. In the present embodiment, this maximum sheet passing width W1 is A3 size width 297 mm (A3 portrait feeding). The effective heat generating area width A of the heater in the longitudinal direction thereof is made a little greater than this maximum sheet passing width W1. W3 represents the sheet passing width (minimum sheet passing width) of a minimum width recording material suppliable to the apparatus. In the present embodiment, this minimum sheet passing width W3 is A4 portrait size width 210 mm (A4 portrait feeding). W2 is the sheet passing width of a recording material having a width between the above-mentioned maximum width recording material and minimum width recording material. In the present embodiment, B4 size width 257 mm (B4 portrait feeding) is shown as the sheet passing width W2. Hereinafter, a recording material of a width corresponding to the maximum sheet passing width W1 will be refereed to as the maximum size recording material, and a recording material smaller in width than this recording material will be referred to as the small size recording material.

The letter "a" represents the difference width portion ((W1−W2)/2) between the maximum sheet passing width W1 and the sheet passing width W2, and the letter "b" represents the difference width portion ((W1−W3)/2) between the maximum sheet passing width W1 and the minimum sheet passing width W3. That is, these are non-sheet passing portions occurring when a recording material of B4 or A4R which is the small size recording material has been passed. In the present embodiment, the recording material passing is the center reference and therefore, the non-sheet passing portions "a" and "b" occur on the left and right side portions of the sheet passing width W2, and the left and right side portions of the sheet passing width W3, respectively. The widths of these non-sheet passing portions various differ depending on the magnitude of the width of the small size recording material being supplied.

The first temperature sensor TH1 is disposed so as to detect the heater temperature of the area corresponding to the minimum sheet passing width W3 (=the temperature of the sheet passing portion). TH2 designates a second temperature sensor (second temperature detecting means: end portion temperature sensor) such as a thermistor, which detects the temperature of the non-sheet passing portion. The output thereof (a signal value regarding the temperature) is inputted to the CPU 171 through an A/D converter and the input/output port 173. In the present embodiment, this temperature sensor TH2 is disposed in elastic contact with the inner surface of the base layer of a fixing film portion corresponding to the non-sheet passing portion "a". Specifically, this temperature sensor TH2 is disposed at the free end of a leaf spring-shaped elastic supporting member 38 having its base portion fixed to the guide member 34. This temperature sensor TH2 is elastically brought into contact with the inner surface of the base layer 33*a* of the film by the elasticity of the elastic supporting member 38 to thereby detect the temperature of the film portion corresponding to the non-sheet passing portion "a".

The first temperature sensor TH1 may be disposed elastically in contact with the inner surface of the base layer of a film portion corresponding to the sheet passing portion W3. Conversely, the second temperature sensor TH2 may be disposed so as to detect the heater temperature corresponding to the non-sheet passing portion "a".

(2-2) Air Blowing Cooling Mechanism Portion 20B

Figure 10:
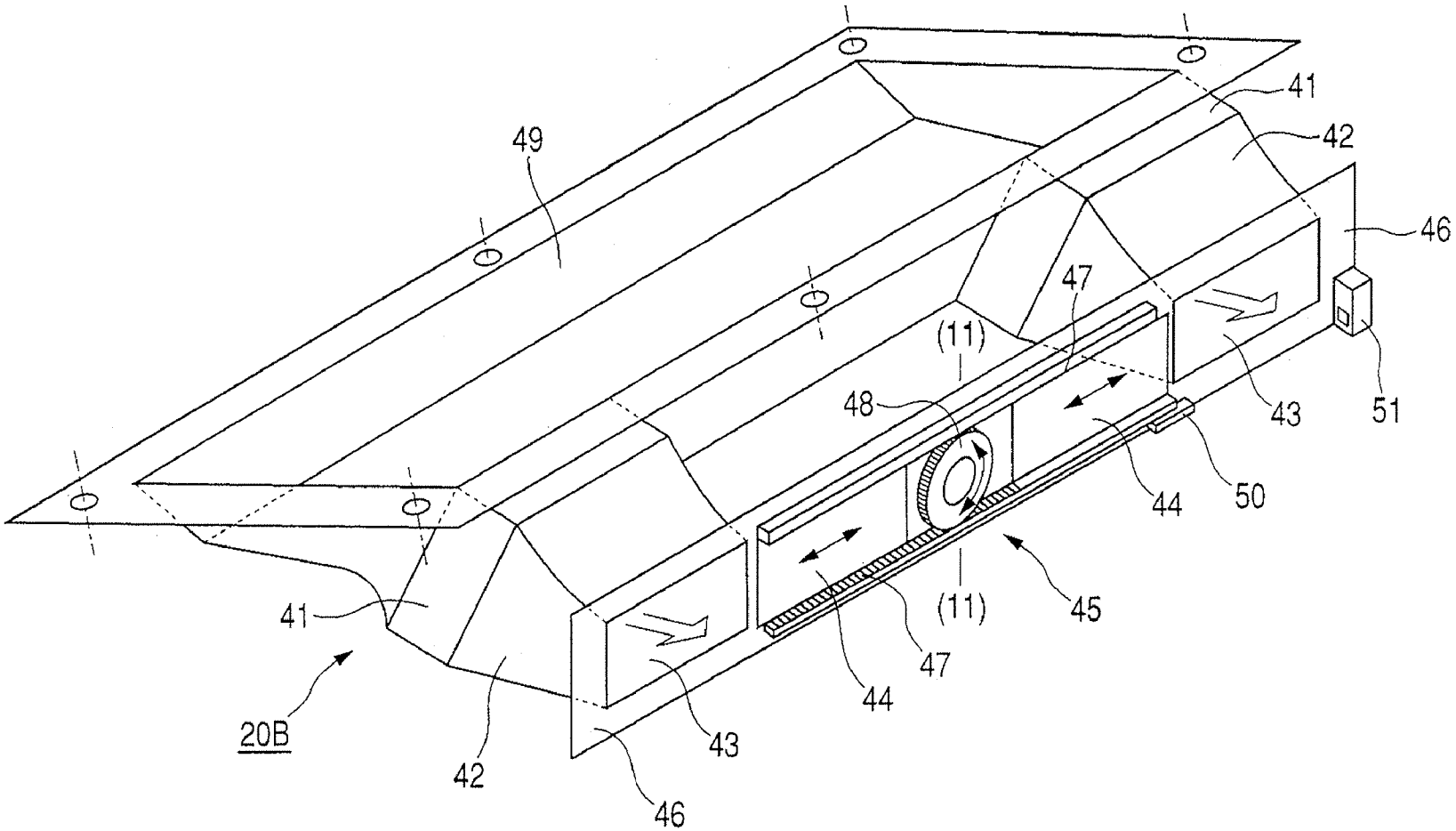
FIG. 10 is a pictorial perspective typical view of an air blowing cooling mechanism portion.
Figure 11:
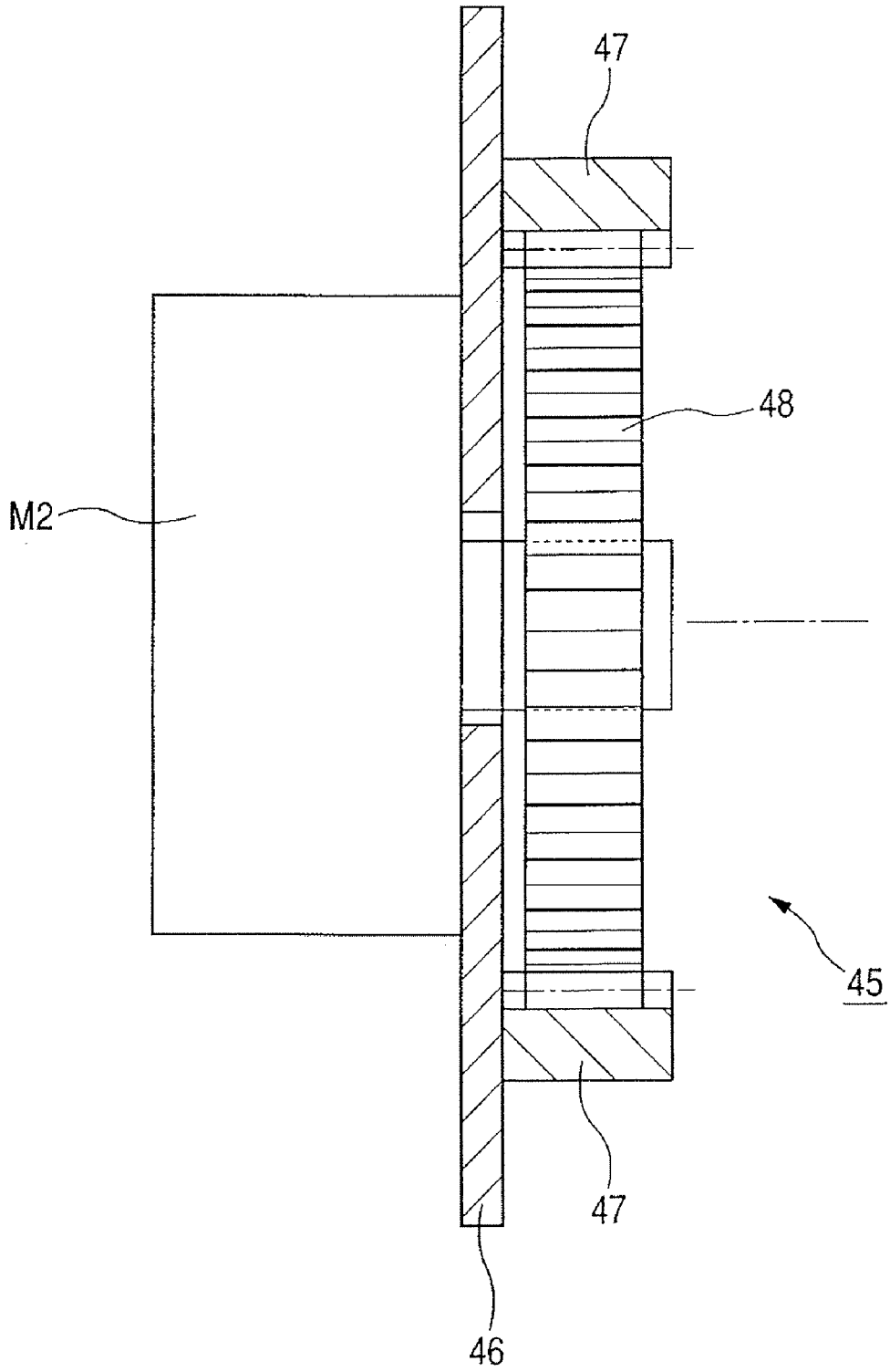
FIG. 11 is an enlarged cross-sectional view taken along the line 11-11 of FIG. 10.

The air blowing cooling mechanism portion 20B is cooling means for cooling the temperature rise of the non-sheet passing portion of the fixing mechanism portion 20A occurring when small size recording materials are continuously passed (small size job). FIG. 10 is a pictorial perspective typical view of this air blowing cooling mechanism portion 20B. FIG. 11 is an enlarged cross-sectional view taken along the line 11-11 of FIG. 10.

The air blowing cooling mechanism portion 20B in the present embodiment will now be described with reference to FIGS. 1, 10 and 11. This mechanism portion 20B has air blowing fans (hereinafter simply referred to as the fans) 41 which are air blowing means, air blowing ducts 42 for directing the air produced by these fans 41, and an air blowing ports (duct opening portions) 43 disposed at those portions of these air blowing ducts 42 which are opposed to the fixing mechanism portion 20A. Also, it has shutters (closure plates) 44 for adjusting the opening width of these air blowing ports 43 to a width suitable for the width of the passed recording material, and a shutter driving device (opening width adjusting means) 45 for driving these shutters.

The fans 41, the air blowing ducts 42, the air blowing ports 43 and the shutters 44 are symmetrically disposed on the left and right portions of the film 33 in the longitudinal direction thereof. The reference numeral 49 denotes an intake channel portion disposed on the intake side of the fans 41. It is possible to use centrifugal fans such as sirocco fans as the fans 41.

The left and right shutters 44 are supported for sliding movement in a horizontal direction along the plate surface of a supporting plate 46 extending in a horizontal direction and formed with the air blowing ports 43. These left and right shutters 44 are communicated with each other by rack teeth 47 and a pinion gear 48, and the pinion gear is driven for forward rotation or reverse rotation by a motor (pulse motor) M2. Thereby, the left and right shutters 44 are operatively associated with each other so as to open-close-move in a bilaterally-symmetric relation relative to the air blowing ports 43 corresponding thereto. A shutter driving apparatus 45 is constituted by the supporting plate 46, the rack teeth 47, the pinion gear 48 and the motor M2.

The left and right air blowing ports 43 are provided from locations slightly nearer to the center than the non-sheet passing portion b occurring when a recording material of the minimum width is passed to the maximum sheet-passing width W1. The left and right shutters 44 are disposed in an orientation for closing the air blowing ports 43 by a predetermined amount outwardly from the longitudinal center of the supporting plate 46.

The CPU 171 has inputted thereto the width information W (FIG. 10) of the recording material passed on the basis of such information as the input of the recording material size used by the user, and the recording material width automatic detecting mechanism (not shown) of the cassette sheet supplying portions 13A, 13B, 13C and the manually feeding tray 17. Then, the CPU 171 controls the shutter driving apparatus 45 on the basis of that information. That is, the motor M2 is driven to thereby rotate the pinion gear 48, and the shutters 44 are moved by the rack teeth 47, whereby the air blowing ports 43 can be opened by a predetermined amount.

Figure 12:
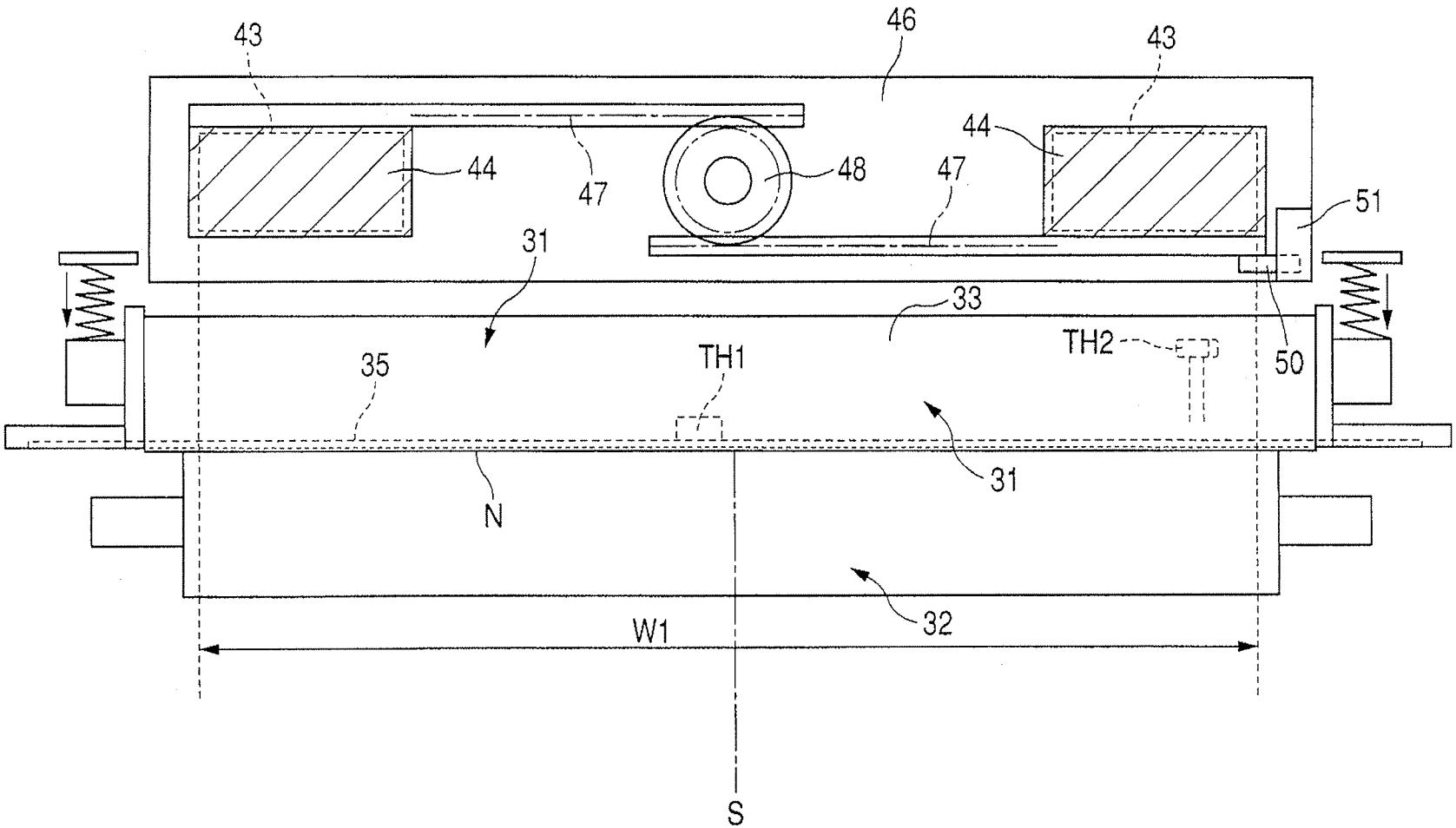
FIG. 12 shows a state in which a shutter has been moved to a fully closed position in which it fully closes an air blowing port.
Figure 13:
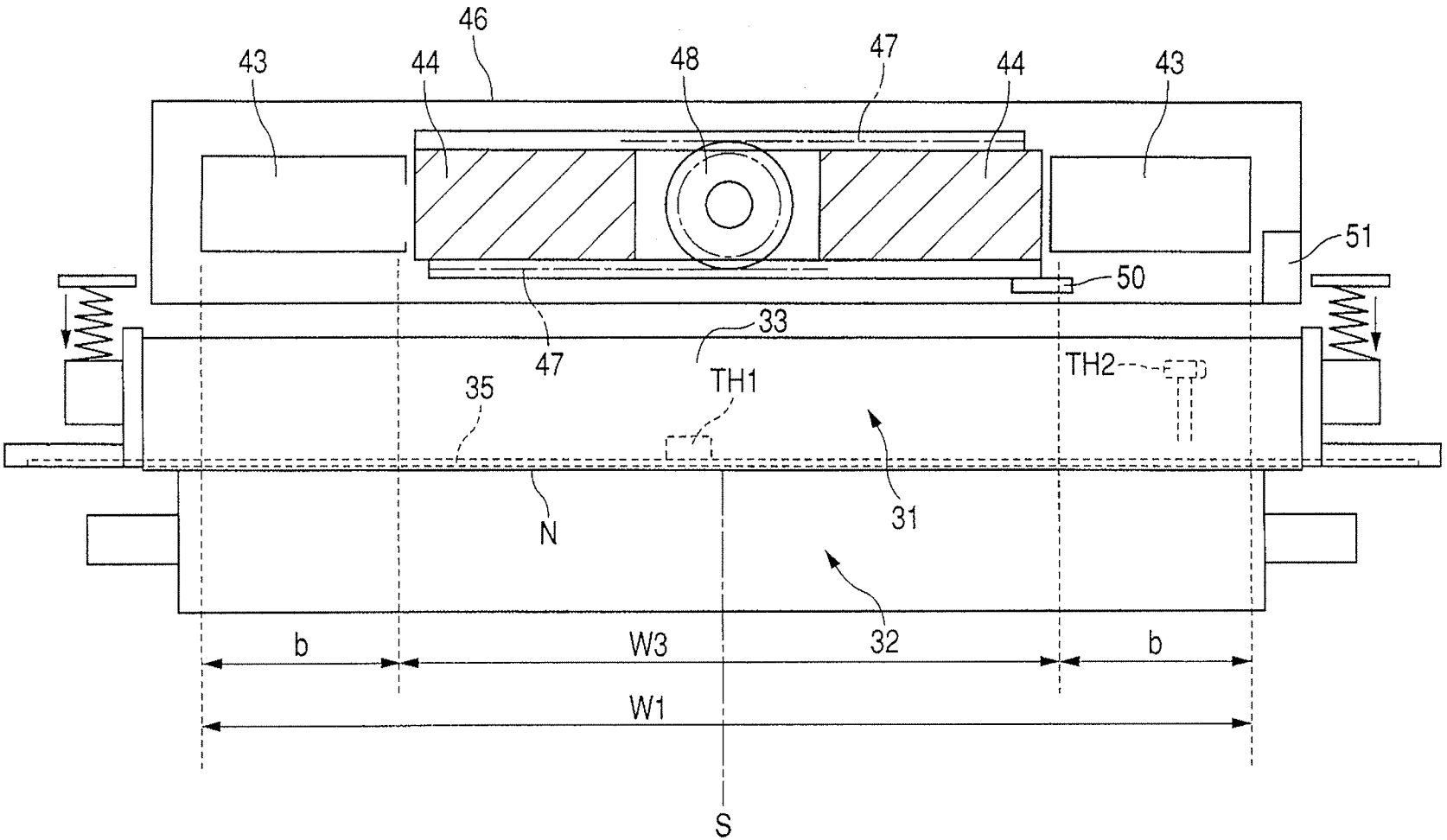
FIG. 13 shows a state in which the shutter has been mobbed to a fully opened position in which it fully opens the air blowing port.
Figure 14:
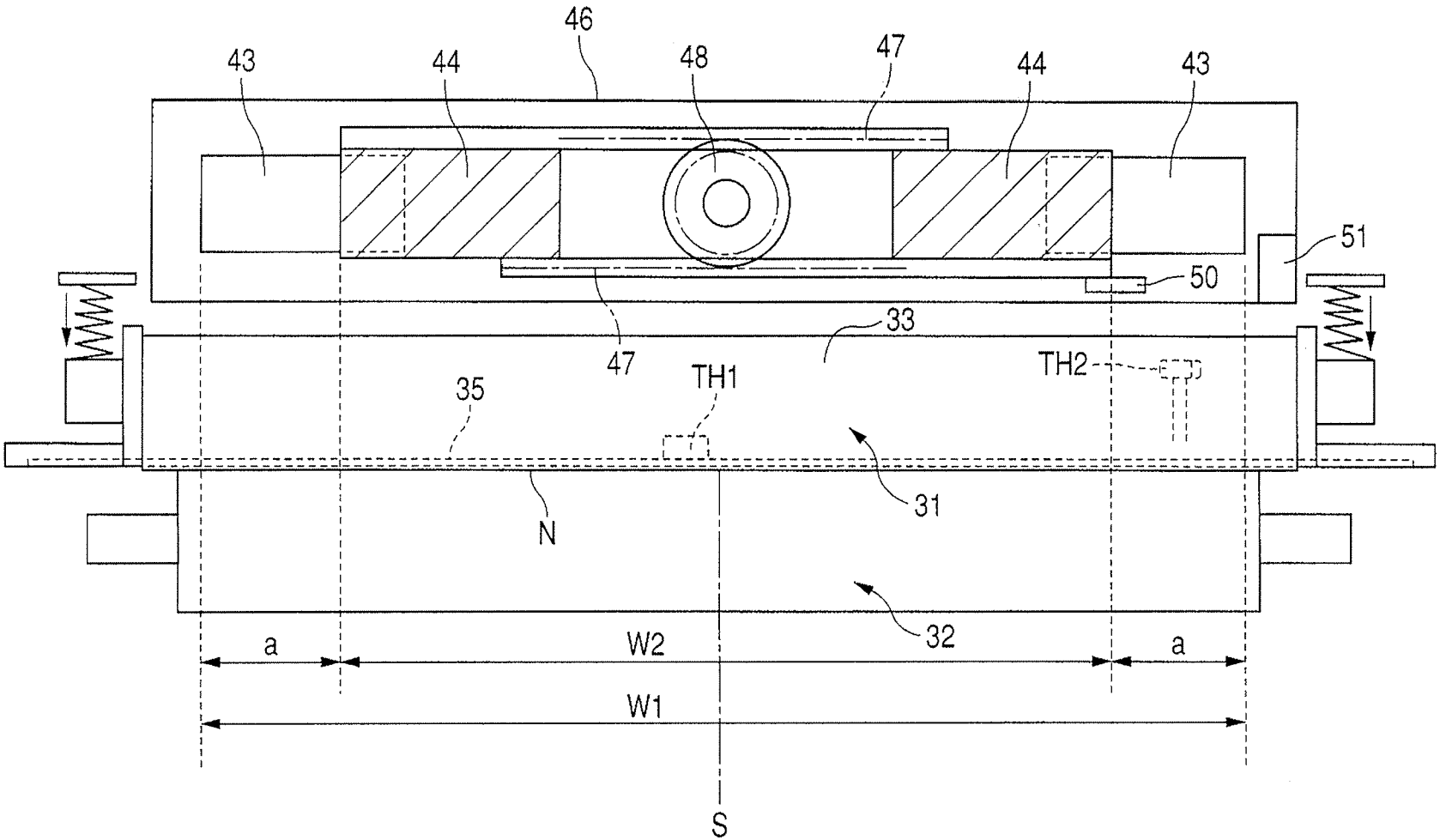
FIG. 14 shows a state in which the shutter has been moved to a position in which it opens the air blowing port only in a portion thereof corresponding to a non-sheet passing portion "a".

The CPU 171, when the width information of the recording material represents a large size recording material of A3 size width, controls the shutter driving apparatus 45 and moves the shutters 44 to their fully closed position in which the air blowing ports 43 are fully closed, as shown in FIG. 12. Also, when the width information of the recording material represents a small size recording material of A4R size width, the CPU 171 moves the shutters 44 to their fully opened position in which the air blowing ports 43 are fully opened, as shown in FIG. 13. Also, when the width information of the recording material represents a small size recording material of B4 size width, the CPU 171 moves the shutters to their position in which only the portions of the air blowing ports 43 which correspond to the non-sheet passing portion "a" are opened, as shown in FIG. 14.

That is, the shutters 44 can adjust the opening width of the air blowing ports 43 in accordance with the width of the recording material.

Although not shown in the drawings, when the small size recording material being passed is LTR-R, EXE, K8, LTR or the like, the CPU 171 moves the shutters 44 to a position in which the air blowing ports are opened by an amount corresponding to a non-sheet passing portion occurring in those cases.

Here, the minimum, maximum and all paper sizes in the present embodiment refer to the specification sheets the image forming apparatus main body guarantees, and are not indefinite size sheets the user uses uniquely.

The position information of the shutters 44 is detected by a sensor 51 disposed on the supporting plate 46 having disposed thereon a flag 50 disposed at a predetermined location on the shutter 44. Specifically, as shown in FIG. 13, the home position is determined in a shutter position in which the air blowing ports 43 are fully opened, and the opening amount is detected from the rotation amount of the motor M2.

It is also possible to provide an opening width detecting sensor for directly detecting the current positions of the shutter 44, feed back the shutter position information by this sensor to the CPU 171, and movement-control the shutters 44 to a proper opening width position correspondingly to the width of the passed recording material. As regards the stopped position of the shutters 44, the edge positions of the shutters are detected by a sensor, whereby a position corresponding to the length of a small size recording material in the width direction thereof can be determined with good accuracy. Accordingly, the blowing of the cooling air can be effected only to the non-sheet passing area of all small size recording materials.

(2-3) Control of the Air Blowing Cooling Mechanism

The present invention has as its object to make the movement of the shutters 44 necessary minimum to thereby achieve the longer life of the shutter driving portion, and further achieve a reduction in noise resulting from the movement of the shutters. In the case of the image forming apparatus as described above, it is necessary to change the width of the opening portion 43 of the air blowing cooling mechanism portion 20B in accordance with the size of the recording material. For example, in such a case where the changeover of the size of the recording material in a job occurs frequently, it is sometimes the case that the movement of the shutters is executed each time the size is changed over. Description will hereinafter be made specifically of an embodiment which optimizes the frequency of execution of the movement of the shutters.

Figure 15:
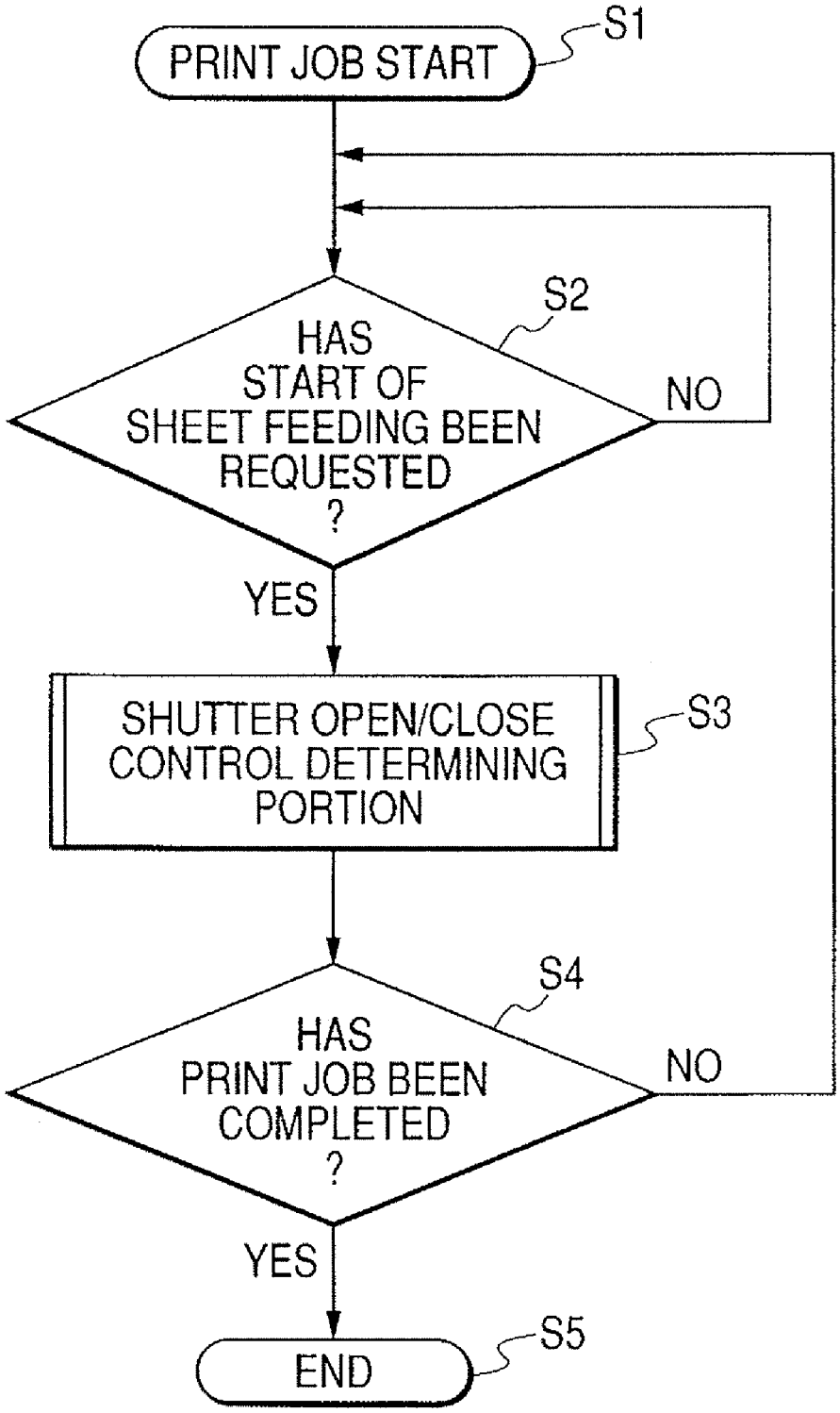
FIG. 15 is a flow chart (1) of the shutter open-close control.

FIG. 15 shows a control flow chart after a print job has been started. A controlling portion in the ROM (174) in the interior of the image forming apparatus receives a print job starting signal through the CPU 171. Next, when it receives a request for starting sheet feeding (S1), the request for starting sheet feeding and data regarding sheet feeding/image formation such as paper size and material are reported to a shutter open-close control determining portion. The procedure of these steps S2 and S3 is continued until the print job is completed (S4).

Figure 16:
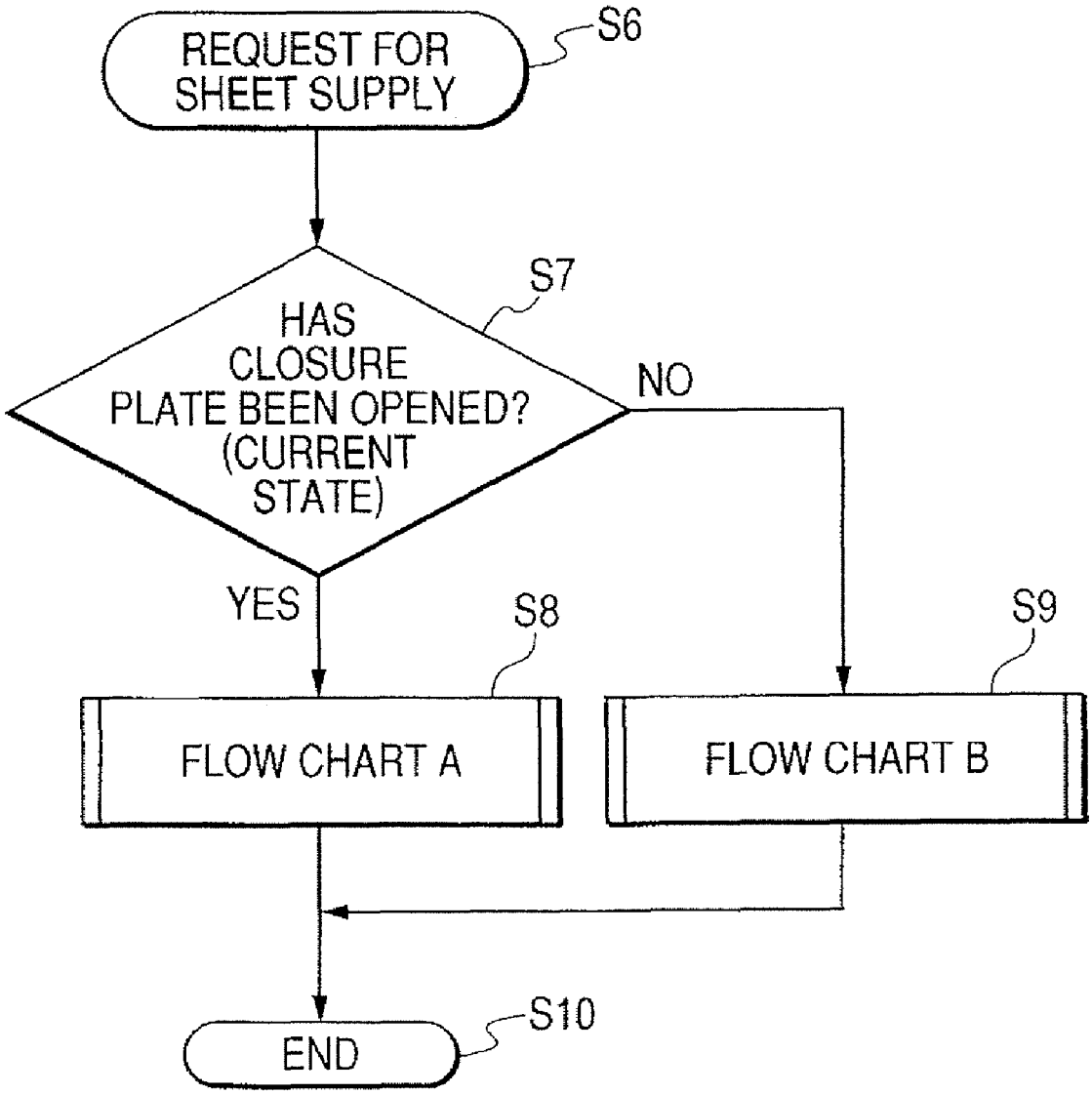
FIG. 16 is a flow chart (2) of the shutter open-close control.
Figure 17:
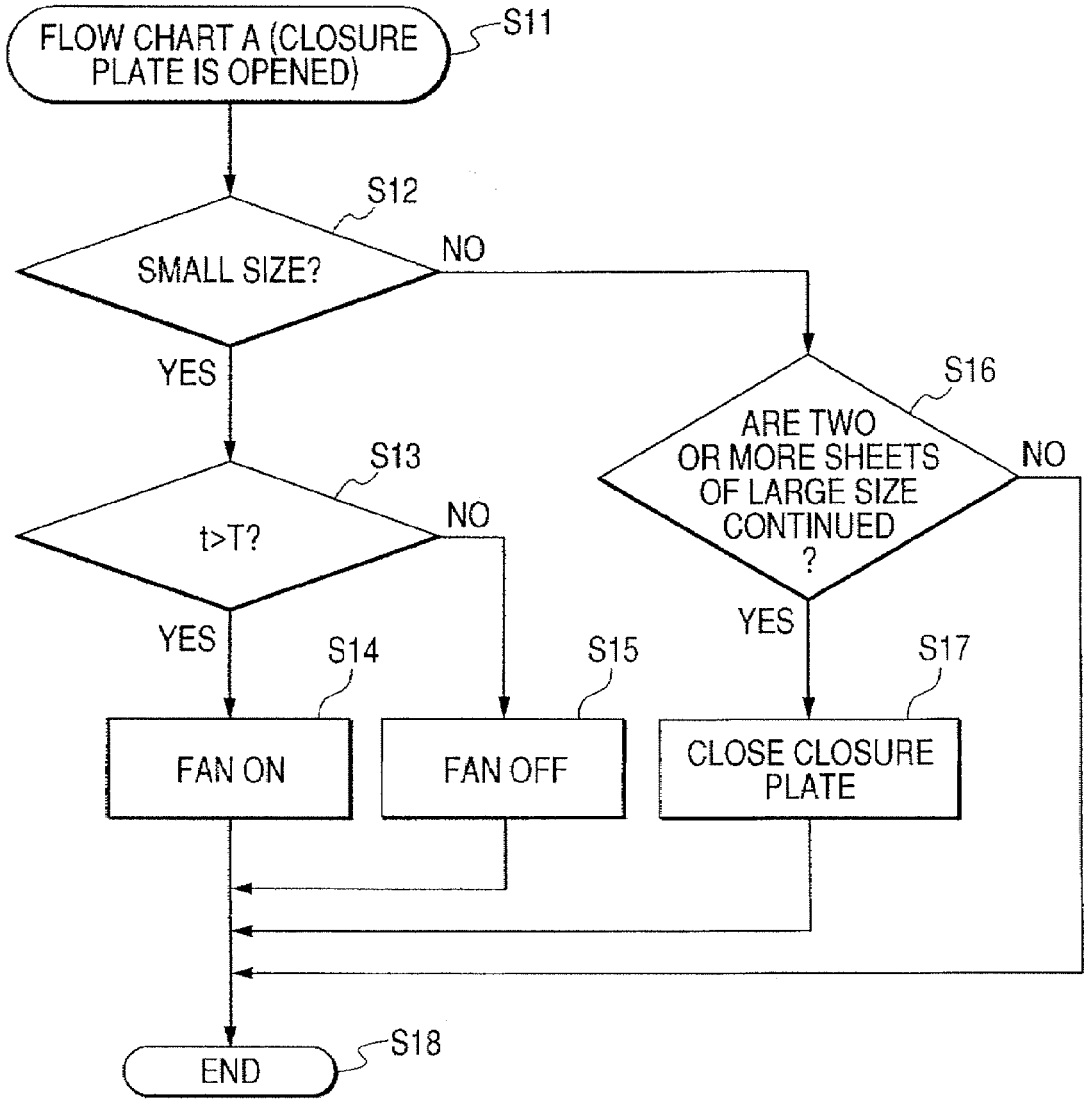
FIG. 17 is a flow chart (3) of the shutter open-close control.
Figure 18:
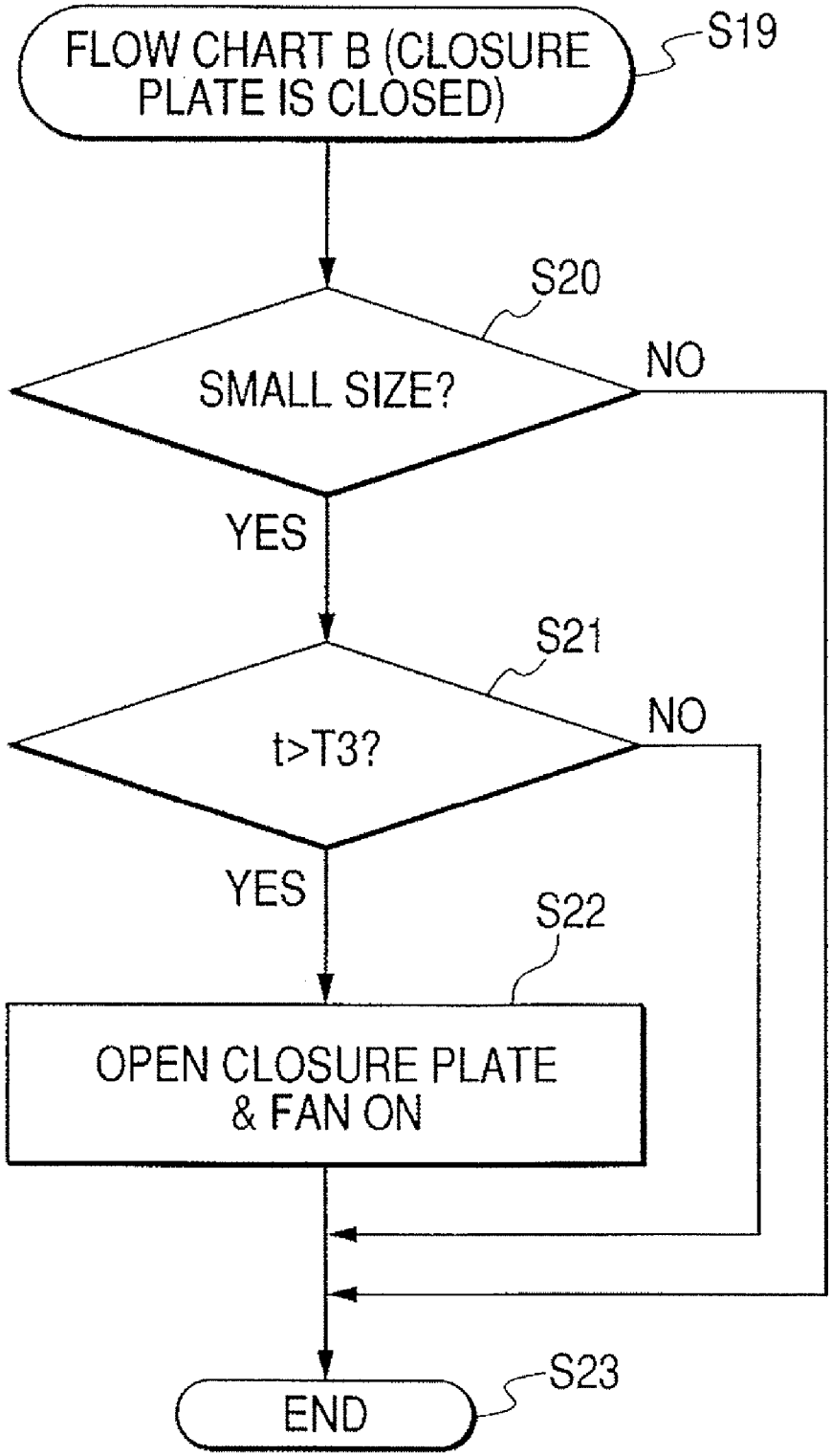
FIG. 18 is a flow chart (4) of the shutter open-close control.

The shutter open-close control determining portion will now be described in greater detail. FIGS. 16, 17 and 18 show flow charts of the shutter open-close control determining portion. When the aforementioned request for starting sheet feeding is received (S6), if the shutters 44 are opened, the processing of a flow chart A (S8) is executed. On the other hand, if the shutters 44 are closed, the processing of a flow chart B (S9) is executed.

Description will first be provided of the flow chart A shown in FIG. 17. In a case where the request for starting sheet supply is received when the shutters 44 are opened, whether the paper size of the sheet of which the supply is to be started from now is a small size is judged (S12). If the paper size of the supplied sheet is a small size, the result of the temperature detection by the second temperature sensor TH2 which detects the temperature of the non-sheet passing portion is compared with a control value T used for the judgment of the driving of the air blowing fans 41 (S13). If the detected temperature "t" is greater than T, the air blowing fans 41 are driven (S14), and if the detected temperature "t" is lower than T, the driving of the air blowing fans 41 is stopped (S15). The changeover of the air blowing fan driving control is carried out after the image formation of the preceding page has been completed and the paper has passed through the fixing nip.

Next, if the paper size to be supplied is a large size (S12), when two or more sheets of large size paper are continuously passed, the control of closing the shutters 44 is carried out (S17). On the other hand, if the changeover to large size paper is one page (S16), the judgment is terminated without the shutters 44 being moved (S18).

FIG. 19C shows the relation between the paper size and the shutter position when the present control is carried out. If as shown in FIG. 19C, only one sheet of large size paper has been printed when small size paper is being continuously passed, the movement of the shutters is not effected.

On the other hand, when two or more sheets of large size paper are passed, the shutters 44 are closed, as shown in FIG. 19B. When large size paper which does not require the driving of the air blowing fans with the shutters 44 remaining opened is to be continuously printed, the temperature of the air blowing fans 41 rises more than necessary, and this is not desirable. Particularly when fans of low cost low in heat-resisting performance are used, it is feared that the fans are destroyed by the heat from the fixing mechanism portion 20A.

Also, in a case where as shown in FIG. 19E, large size paper and small size paper are alternately printed after the continuous passing of small size paper, it is possible to continue the printing operation without moving the shutters 44. This is because from the following, the driving of the air blowing fans 41 and the movement of the shutters 44 are not necessary. That is, the temperature of the non-sheet passing portion when the passing of small size paper is effected will not rise so much in the case of several sheets of small size paper. Also, small size paper and large size paper are alternately passed, whereby the temperature distribution on the shaft of the fixing device becomes constant to a certain extent.

However, when as previously described, the fans of low cost are used, in a state in which the shutters are opened for a predetermined or greater number of sheets with the heat-resisting performance of the air blowing fans 41 taken into account and in a case where the driving of the air blowing fans is not effected, it is desirable to close the shutters 44. This control is shown in FIG. 19F.

Figure 20:
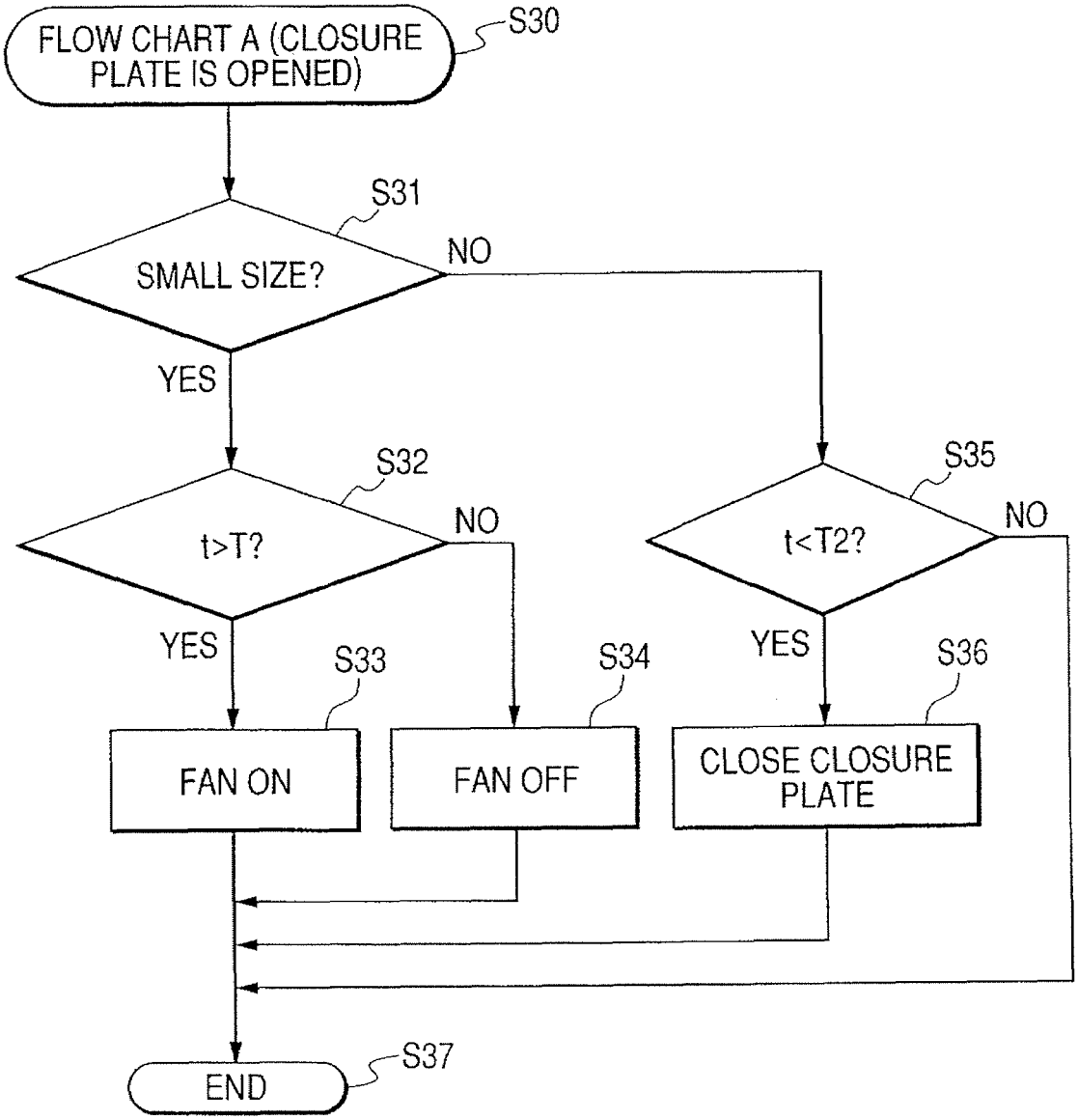
FIG. 20 is a flow chart (5) of the shutter open-close control.
Figure 21:
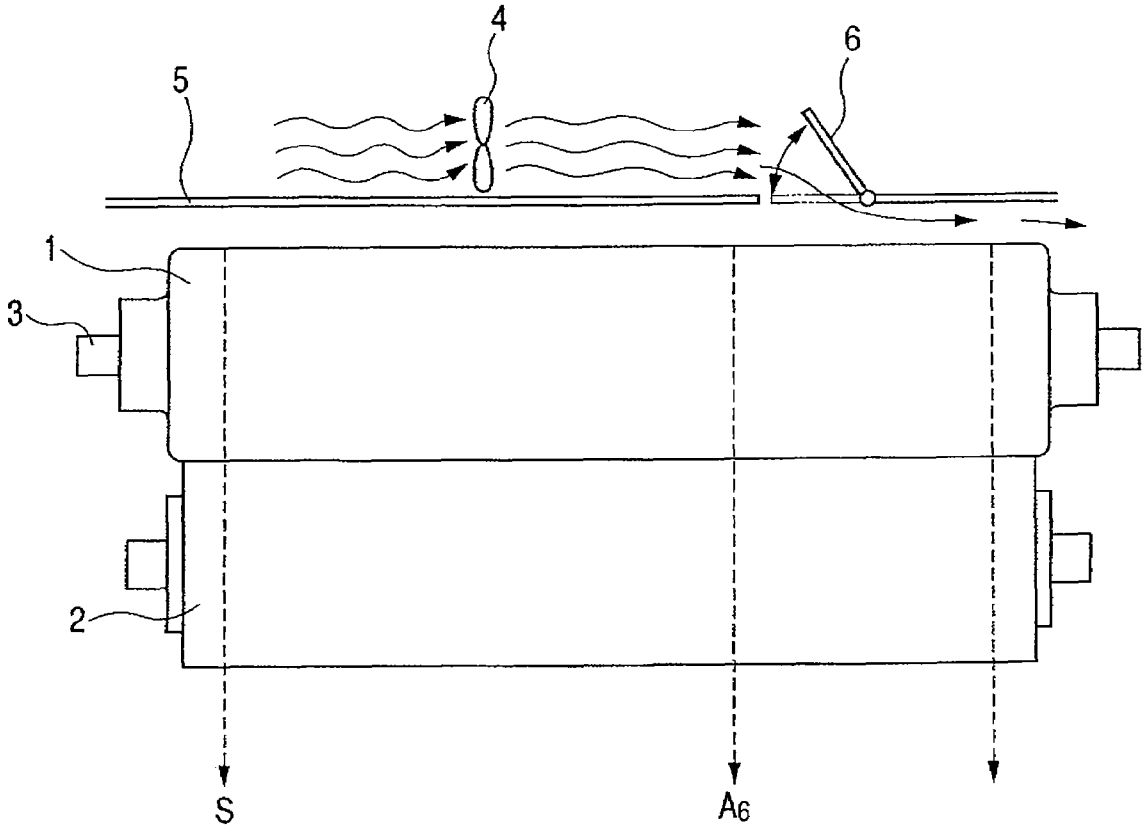
FIG. 21 PRIOR ART
FIG. 21 shows the construction of a conventional example.

While in the present embodiment, description has been made of the control of changing the position of the shutters 44 when two or more sheets of large size paper have been continued, the present invention is not restricted thereto, but for the judgment of the changing of the position of the shutters, it is possible to suitably control by the number of continuous sheets. Also, for the judgment as to whether the shutters 44 should be closed, it is also possible to control by the use of the second temperature sensor TH2 which detects the temperature of the non-sheet passing portion. FIG. 20 shows a flow chart thereof. When the passing of large size paper is effected with the shutters 44 opened, the result of the detection by the second temperature sensor TH2 is compared with T2 used for the judgment as to whether the shutters 44 should be closed (S35). If the result of the detection is lower than the predetermined value T2, that is, if it is judged that the temperature of the non-sheet passing portion has been sufficiently lowered, the control of closing the shutters 44 (S36) is carried out.

Also, likewise, a construction using time for the judgment as to whether the shutters 44 should be closed is possible. A construction in which the time after the passing of small size paper is measured and when a predetermined time has elapsed as the time, the control of closing the shutters 44 is carried out is also possible.

Reference is now had to the flow chart B of FIG. 18 to describe the control when the paper size of sheet passing has changed in a state in which the shutters 44 are closed.

When request data for sheet feeding is received in the state in which the shutters 44 are closed, comparison by the paper size is first effected (S20), and if the paper size is a small size, the result "t" of the detection by the second temperature sensor TH2 is compared with a control value T3 used for the judgment as to whether the shutters 44 should be opened. If "t" has become greater than T3, the shutters 44 are opened and the driving of the air blowing fans 41 is started (S22). Also, if "t" is lower than T3, or if the paper size is not a small size, the control of the movement of the shutters is not effected and the judgment is ended (S23).

FIGS. 19A and 19D show the relation between the paper size and the position of the shutters when the flow chart B is carried out.

FIG. 19A will now be described. If small size paper is passed after large size paper has been continued, the control of the air blowing fans and the control of the movement of the shutters are not effected until the result of the detection by the second temperature sensor TH2 rises to a predetermined value. At a point of time whereat the result of the detection by the second temperature sensor TH2 has reached the predetermined value, the driving of the air blowing fans and the control of the movement of the shutter are carried out.

FIG. 19D will now be described. If large size paper and small size paper are alternately passed after large size paper has been continuously passed, the sheet passing operation is continued without the control of the driving of the air blowing fans 41 and the control of the movement of the shutters 44 being carried out. Again in this case, as previously described, even if several sheets of small size paper are passed, the temperature of the non-sheet passing portion does not rise so much, and if small size paper and large size paper are alternately passed, the temperature distribution on the shaft of the fixing device becomes constant to a certain extent and therefore, continuous sheet passing is possible without the cooling control by the air blowing fans 41.

Summing up, not only the opening and closing of the shutters 44 are simply controlled in accordance with the detected temperature by the second temperature sensor TH2 which detects the temperature of the non-sheet passing portion or the size of the passed recording material, but the opening and closing of the shutter 44 are controlled in accordance with a change in the size of continuous recording materials. In the case of the changeover from a small size recording material to a large size recording material, even if the shutters 44 are opened, the control of the fans is stopped, whereby the influence upon image formation is eliminated. However, if the passing of large size recording materials is continued, it will affect the temperature rise of the interior of the machine (the air blowing fans installed nearby are deteriorated by heat) and therefore, the shutters 44 are closed. In the case of the changeover from a large size recording material to a small size recording material, the effect of the control of the fans is null unless the shutters 44 are opened and therefore, the shutters 44 are opened at once. If the recording material is of a small size and the shutters 44 are opened, the fans 41 are ON. If the recording material is of a large size and the shutters 44 are closed, the fans 41 are OFF.

In the foregoing, the same may be said of a case where judgment is effected on the basis of the detected temperature by the second temperature sensor TH2 which detects the temperature of the non-sheet passing portion being higher/lower than the threshold value, instead of the size of the recording material.

Also, the timing at which the shutters 44 are closed during the continuous passing of large size recording materials may likewise be the time elapsed, instead of the number of continuous sheets.

Thereby, the following effect is obtained in a fixing apparatus wherein only the non-sheet passing portion is fan-cooled by the opening portions 43 opened and closed by the shutters 44 moved in accordance with the detected temperature by the second temperature sensor TH2 which detects the temperature of the non-sheet passing portion or the size of the recording material. That is, it is possible to reduce the frequency of the driving of the shutters when small size recording materials and large size recording materials are mixed-loaded and passed, to thereby achieve the longer life of the shutter driving portion, the electric power saving of the apparatus and a reduction in opening-closing noise.

While in Embodiment 1 described above, the paper sizes passed have been described as small size paper and large size paper, the present invention is not restricted thereto, but can also be carried out for small size paper and sizes larger than the small size paper and smaller than the large size paper.

Thus, by such an apparatus construction as will be described below, when a print job in which large size recording materials and small size recording materials are mixedly present is to be executed, the control of the driving of the shutters is carried out at optimum timing, whereby the longer life of the shutter driving portion and further, the electric power saving of the apparatus and the prevention of noise have been achieved. As the result, there can be provided an image forming apparatus which can prevent a reduction in throughput when image formation on a small size recording material is effected, by a low-cost and compact construction.

1) When the width of the recording material changes in the course of a continuous image forming operation accompanied by a cooling operation, the shutters 44 are kept opened until the number of recording materials after the change reaches a predetermined number.

2) The shutters 44 can adjust the opening width of the air blowing ports 43 in accordance with the width of the recording material, and when the width of the recording material changes in the course of the continuous image forming operation accompanied by the cooling operation, the position of the shutters 44 is kept as it is until the number of recording materials after the change reaches a predetermined number.

3) The position of the shutters 44 is kept as it is until with the air blowing of the air blowing fans 41 stopped, the number of conveyed recording materials after the change reaches a predetermined number.

4) When the width of the recording material changes in the course of the continuous image forming operation accompanied by the cooling operation, the shutters 44 are kept opened until an image heating processes time for the recording material after the change reaches a predetermined time.

5) When the width of the recording material changes in the course of the continuous image forming operation accompanied by the cooling operation, the position of the shutters is kept as it is until the image heating process time for the recording material after the change reaches the predetermined time.

6) The position of the shutters is kept as it is until with the air blowing of the air blowing fans 41 stopped, the image heating time for the recording material after the change reaches a predetermined time.

While in the foregoing, the fans 41 are of a construction which cools the fixing member, a similar effect will also be obtained if it is of a construction which cools the pressure member.

While in the foregoing, the heating rotary member 33 is of a thin-walled roller type of low heat capacity, this is not restrictive, but a fixing member of a left type will also lead to the obtainment of a similar effect.

The image heating means (fixing device) 20A is not restricted to a heating device of a film heating type, but can be a heating device of a heat roller type or a heating device of other construction. It can also be made into an apparatus of an electromagnetic induction heating type.

Also, the image heating means 20A can obtain a similar effect even if it is of a construction in which the passing of the recording material is effected with one-side conveyance reference.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-265881, filed Sep. 13, 2005 which is hereby incorporated by reference herein in its entirety.

What is claimed is:

1. An image heating apparatus comprising:

image heating means for heating an image on a recording material in a nip portion;

air blowing means for blowing air toward an air blowing port to cool a predetermined area of said image heating means; and a shutter which opens and closes said air blowing port, wherein said shutter can adjust an opening width of said air blowing port in accordance with a width of the recording material, and when recording materials change in width in the course of continuously executing the image heating process accompanied by the cooling operation, a position of said shutter is kept as it is until the number of recording materials after the change reaches a predetermined number.

2. An image heating apparatus comprising:

image heating means for heating an image on a recording material in a nip portion;

air blowing means for blowing air toward an air blowing port to cool a predetermined area of said image heating means; and a shutter which opens and closes said air blowing port, wherein said shutter can adjust an opening width of said air blowing port in accordance with a width of the recording material, and when recording materials change in width in the course of continuously executing the image heating process accompanied by the cooling operation, said shutter is kept opened until the image heating process time for recording materials after the change reaches a predetermined time.

* * * * *